US009316097B2

(12) United States Patent
Stancliffe et al.

(10) Patent No.: US 9,316,097 B2
(45) Date of Patent: Apr. 19, 2016

(54) IN SITU GRAVITY DRAINAGE SYSTEM AND METHOD FOR EXTRACTING BITUMEN FROM ALTERNATIVE PAY REGIONS

(71) Applicant: Suncor Energy Inc., Calgary (CA)

(72) Inventors: Russell Peter Warren Stancliffe, Calgary (CA); Grant John Duncan, Calgary (CA); Clayton Robert Phair, Calgary (CA); Gordon Theodore Stabb, Calgary (CA)

(73) Assignee: SUNCOR ENERGY INC., Calgary (CA)

( * ) Notice: Subject to any disclaimer, the term of this patent is extended or adjusted under 35 U.S.C. 154(b) by 0 days.

(21) Appl. No.: 14/480,338

(22) Filed: Sep. 8, 2014

(65) Prior Publication Data

US 2016/0069171 A1 Mar. 10, 2016

(51) Int. Cl.

| | |
|---|---|
| ***E21B 43/24*** | (2006.01) |
| ***E21B 43/30*** | (2006.01) |
| ***E21B 43/16*** | (2006.01) |
| ***E21B 7/04*** | (2006.01) |

(52) U.S. Cl.

CPC ..... *E21B 43/2406* (2013.01); *E21B 7/046* (2013.01); *E21B 43/164* (2013.01); *E21B 43/168* (2013.01); *E21B 43/305* (2013.01)

(58) Field of Classification Search

CPC ..... E21B 43/24; E21B 43/2406; E21B 7/046; E21B 43/305

USPC ..... 166/272.3

See application file for complete search history.

(56) References Cited

U.S. PATENT DOCUMENTS

| | | | | |
|---|---|---|---|---|
| 5,979,228 | A | 11/1999 | Smith et al. | |
| 6,645,769 | B2 | 11/2003 | Tayebi et al. | |
| 8,495,921 | B2 | 7/2013 | Larter et al. | |
| 2005/0188758 | A1 | 9/2005 | Yekutiely et al. | |
| 2007/0044957 | A1 * | 3/2007 | Watson | E21B 33/03 166/245 |
| 2008/0133193 | A1 | 6/2008 | Gdanski et al. | |
| 2008/0135236 | A1 | 6/2008 | Schoell | |
| 2013/0027705 | A1 | 1/2013 | Berman et al. | |

(Continued)

FOREIGN PATENT DOCUMENTS

| | | | | |
|---|---|---|---|---|
| CA | 2653032 | * | 8/2010 | B03B 9/02 |
| WO | 2009059132 | A1 | 5/2009 | |
| WO | 2012106758 | A1 | 8/2012 | |

OTHER PUBLICATIONS

Duncan, Grant; Presentation by Suncor at Integration geoConvention; 2013.

(Continued)

*Primary Examiner* — Catherine Loikith
*Assistant Examiner* — Ryan Schneer
(74) *Attorney, Agent, or Firm* — Brett J. Slaney; Blake, Cassels & Graydon LLP

(57) ABSTRACT

A system and method are provided for recovering bitumen from a bitumen reserve. The method includes recovering bitumen from an alternative pay region in the bitumen reserve via gravity drainage using an inclined horizontally drilled well drilled from a drainage pit upwardly into the bitumen reserve. The drainage pit has been excavated into an area of an underlying formation that is, at least in part, adjacent to and underlying the bitumen reserve. The alternative pay region includes a region unsuitable for recovering bitumen by surface mining or by in situ recovery using wells that produce bitumen to ground level above the alternative pay region.

32 Claims, 24 Drawing Sheets

(56) References Cited

U.S. PATENT DOCUMENTS

| | | | | |
|---|---|---|---|---|
| 2013/0197891 | A1 | 8/2013 | Jessop et al. | |
| 2013/0257055 | A1* | 10/2013 | Simpson | F24J 3/08 290/52 |
| 2014/0096960 | A1* | 4/2014 | Kerr | B08B 9/04 166/272.3 |

OTHER PUBLICATIONS

Deutsch, C.V. et al.; Guide to SAGD (Steam Assisted Gravity Drainage) Reservoir Characterization Using Geostatistics; Centre for Computational Geostatistics (CCG); Guidebook Series vol. 3; Section 1; 2005.

Towson, D.E.; "The Mine-Assisted In Situ Project"; estimated publication date 1980; Petro-Canada Inc.

Campbell, D. et al.; "Log Evaluation and Monitoring of a Unique Heavy Oil Reservoir Project, Albert, Canada"; 1981; Paper No. 82-33-61; Petroleum Society of CIM.

Redford, D.A.; "In-situ recovery from the Athabasca oil sands—past experience and future potential"; 1985; Paper No. 85-03-0; The Journal of Canadian Petroleum.

* cited by examiner

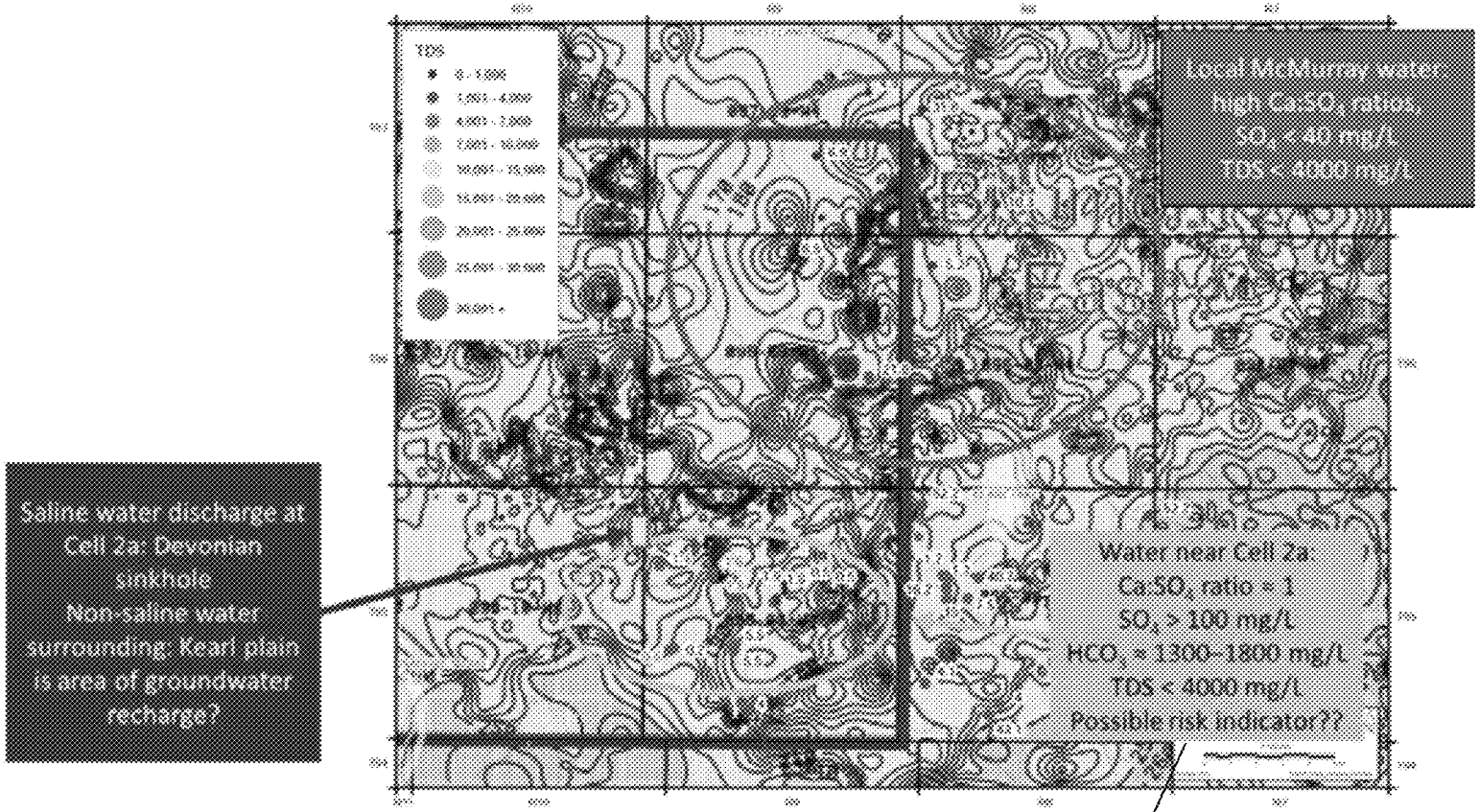
Water near Cell 2:
$CaSO_4$ ratio = 1
$SO_4$ > 100 mg/L
$HCO_3$ = 1300-1800 meq/L
TDS > 4000 mg/L
Possible risk indicator??
Cell 2
Cell 1
Cell 3
Cell 4
Cell 5
Cell 6
Cell 7
Cell 8
Cell 9
Cell 10
Cell 11
Cell 12
Cell 13
Cell 14
Cell 15
Cell 16
Cell 17
Cell 18
Cell 19
Cell 20
Cell 21
Cell 22
Cell

IN SITU GRAVITY DRAINAGE SYSTEM AND METHOD FOR EXTRACTING BITUMEN FROM ALTERNATIVE PAY REGIONS

TECHNICAL FIELD

The following relates to an in situ gravity drainage system and method for extracting bitumen from alternative pay regions.

DESCRIPTION OF THE RELATED ART

Oil sand is a mixture of bitumen, sand and water. Bitumen is known to be considerably viscous and does not flow like conventional crude oil. As such, bitumen is recovered using what are considered non-conventional methods. For example, bitumen reserves are typically extracted from a geographical area using either surface mining techniques, wherein the overburden is removed to access the underlying pay (e.g., ore-containing bitumen) and transported to an extraction facility; or using in situ techniques, wherein subsurface formations (containing the pay) are heated such that the bitumen is caused to flow into one or more wells drilled into the pay while leaving formation rock in the reservoir in place. Both surface mining and in situ processes produce a bitumen product that is subsequently sent to an upgrading and refining facility, to be refined into one or more petroleum products such as gasoline and jet fuel.

Estimates indicate that approximately 20% of the Canadian Athabasca oil sands are close enough to the surface to be mined. The overburden that is removed typically includes layers of muskeg, earth and mudstone, to expose the thick deposit of oil sand. The overburden is stored for future reclamation of surface land upon completion of the mining operation. Large equipment such as excavators and trucks are used to mine and transport the oil sand ore to an extraction facility. The trucks deliver the oil sand ore to crushers, where it is broken down in size. At the extraction facility, typically hot water and caustic soda are added to the crushed ore in tumblers to transform the dry sand into a slurry. Air is then added to the oil sand and water mixture as it is transported to primary separation cells where the bitumen, sand and water are separated from one another. Warm bitumen is then separated from the sand and water and the bitumen is next de-aerated and sent to storage tanks, then on to a refinery. Coarse sands and fine clays are sent to tailings settling ponds, then become fill for the area that was excavated by mining. Water from the extraction process and the tailings settling ponds can then be recycled.

The above-noted estimates also suggest that approximately 80% of the Athabasca oil sands are too deep to feasibly permit bitumen recovery by mining techniques. These deeper formations are typically accessed by drilling wellbores into the hydrocarbon bearing formation.

There are various in situ technologies available, such as steam driven or in situ combustion based techniques. However, currently Steam Assisted Gravity Drainage (SAGD) is considered to be the most popular and effective in situ process. SAGD is an enhanced oil recovery process whereby a long horizontal steam injection well is located above a long horizontal producer well. Injected steam forms a steam chamber above the SAGD well pair, heating the reservoir rock and reservoir fluids. Heated bitumen plus condensed steam flows down the sides of the steam chamber towards the producer well. The condensed steam and bitumen are then lifted to surface with a downhole pump or by gas lift. SAGD typically operates at elevated pressures and elevated temperatures, e.g., with temperatures exceeding 190° C. Once at surface the bitumen and water are separated from one another in treatment vessels that operate at relatively high temperatures (e.g., ±170° C.). Bitumen is sent to refineries, while produced water is recycled. The reservoir rock that once contained the bitumen remains in place, and is not produced to surface.

SAGD has become an increasingly popular method for extracting bitumen from oil sand reservoirs that are too deep for surface mining, largely due to the high recovery factor from SAGD.

Accordingly, surface mining is normally used, and considered economical, when the pay is relatively close to the surface, i.e. the overburden is relatively shallow. In other words, surface mining is not normally used for accessing deep oil sand formations because the volume of overburden that would need to be removed is too great for economic recovery of the bitumen.

In situ techniques such as SAGD are normally used to access deeper pay wherein wellbores are drilled from the surface into the subsurface hydrocarbon-bearing formation. While vertical wellbores can be drilled deep enough to access the oil sands, bitumen recovery from vertical wells has not been found to be as effective as SAGD, which utilizes horizontally drilled wells. Currently, drilling horizontal wells into a shallow formation can be difficult to accomplish due to technical limitations such as in the building angle from surface to horizontal, and turning the wells into a desired direction.

While surface mining can access shallow pay, and in situ techniques can access deeper pay, there can be a band of inaccessible, uneconomical, or "unbookable" pay that is considered too deep for surface mining and too shallow for in situ extraction. Pay can also be or become unbookable for various other reasons, including without limitation, being: adjacent to a surface mine, stranded between surface mining and in situ sites, near bodies of water such as rivers or aquifers, in an area having insufficient cap rock or limestone integrity, adjacent tailing ponds, etc.

SUMMARY

In one aspect, there is provided a method of recovering bitumen from a bitumen reserve, the method comprising: recovering bitumen from an alternative pay region in the bitumen reserve via gravity drainage using an inclined horizontally drilled well drilled from a drainage pit upwardly into the bitumen reserve; wherein the drainage pit has been excavated into an area of an underlying formation that is, at least in part, adjacent to and underlying the bitumen reserve; and wherein the alternative pay region comprises a region unsuitable for recovering bitumen by surface mining or by in situ recovery using wells that produce bitumen to ground level above the alternative pay region.

In another aspect, there is provided a method of planning bitumen recovery from a geographical region using a plurality of recovery processes, the method comprising: determining a first region comprising at least one area of an underlying formation, the underlying formation being adjacent to and at least partially underlying a bitumen-containing reservoir; determining at least one alternative pay region, wherein an alternative pay region comprises a region unsuitable for recovery of bitumen by surface mining or in situ recovery using wells drilled from ground level for producing bitumen to ground level above the alternative pay region; and identifying a location for excavating at least one drainage pit into the at least one area of underlying formation, the at least one drainage pit enabling at least one inclined horizontally drilled well to be drilled towards the at least one alternative pay region to recover bitumen from the at least one alternative pay region.

In yet another aspect, there is provided a system for recovering bitumen from a geographical area, the system comprising: a drainage pit excavated into an area of an underlying formation in a first region, the underlying formation being adjacent to at least partially underlying a bitumen-containing reservoir; at least one inclined horizontally drilled well drilled from the drainage pit and towards an alternative pay region included in the bitumen-containing reservoir, wherein the alternative pay region comprises a region unsuitable for recovery of bitumen by surface mining or in situ recovery using wells drilled from ground level for producing bitumen to ground level above the alternative pay region; and production equipment for operating the well from the drainage pit to recover bitumen from the alternative pay region.

BRIEF DESCRIPTION OF THE DRAWINGS

Embodiments will now be described by way of example with reference to the appended drawings wherein:

FIG. 5(*b*) is a cross-sectional elevation view of a drainage pit incorporating a CSS oil recovery process during a production phase;

FIG. 7(*b*) is a partial perspective view from within a drainage pit, of a three phase electric heat oil recovery process;

FIG. 13(*b*) is a flow chart illustrating a planning method for extracting bitumen in a geographical area;

FIG. 21 illustrates an application of the risk matrix of FIG. 20 to a geographical site.

DETAILED DESCRIPTION

Figure 1:
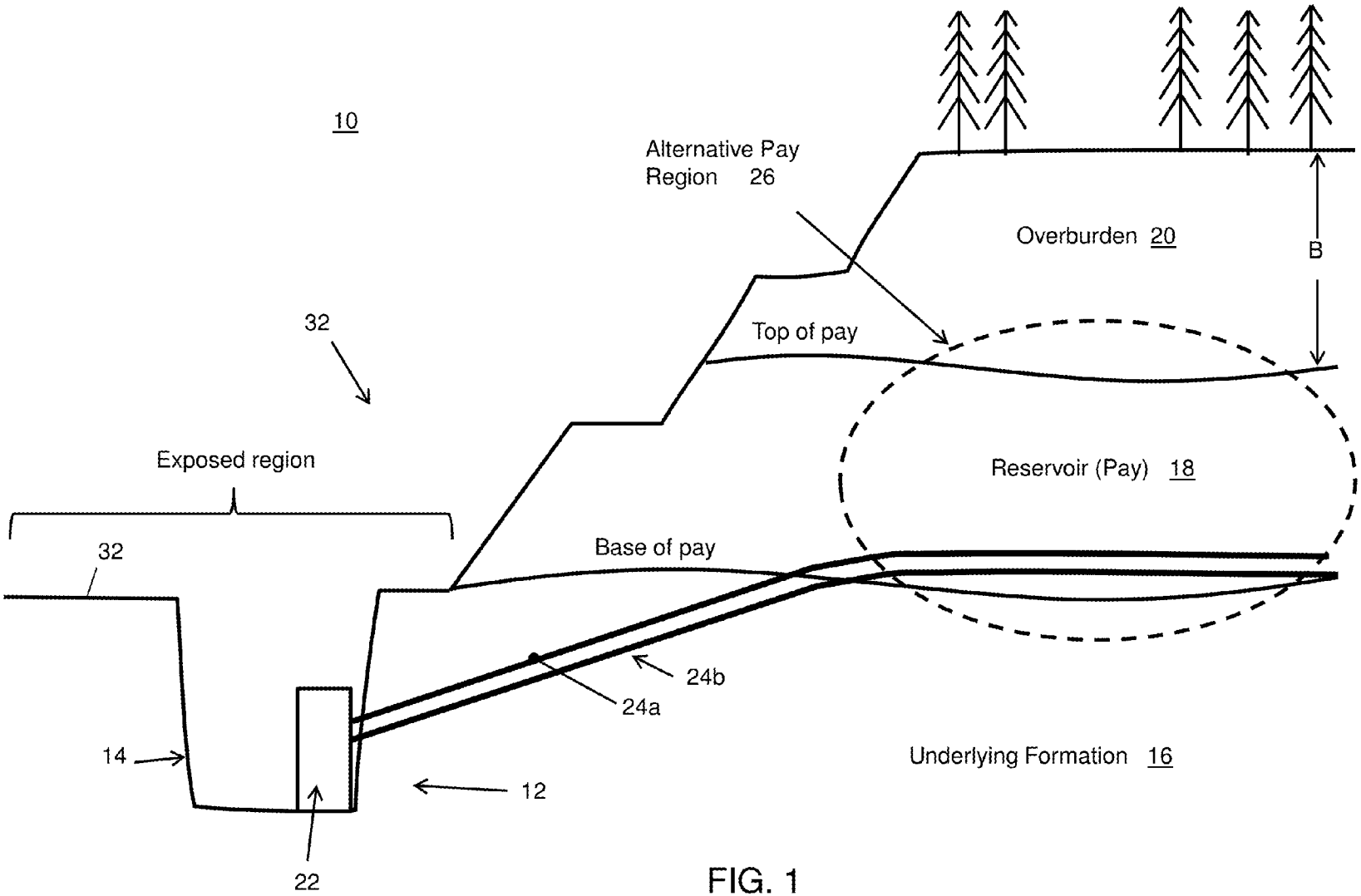
FIG. 1 is a cross-sectional elevation view of a bitumen extraction site for recovering bitumen from an alternative pay region.

It has been recognized that unbookable, stranded, difficult to extract, uneconomical using existing extraction methods (e.g., SAGD, surface mining, etc.), or otherwise "alternative" bitumen reserves can be recovered from corresponding pay zones or regions by excavating a drainage pit into an exposed area of the underlying formation adjacent the pay; drilling one or more inclined horizontally drilled wells from the drainage pit and into the alternative pay region; and applying an enhanced oil recovery technique to the pay region causing produced fluids to drain back into the drainage pit, for example assisted by the influence of gravity. It can be appreciated that pay can be considered "alternative" pay based on any one or more of geological, technical, and economic constraints. For example, an alternative pay region could be otherwise bookable (e.g., accessible via surface mining and/or SAGD), but considered an alternative pay region for being more economically extracted using the in situ gravity drainage method described herein.

In some implementations, the drainage pit can be excavated at the bottom of a surface mine in a suitable area of exposed underlying formation such as the Devonian limestone, or in a naturally or artificially exposed outcrop that is found to be adjacent or near to what would be considered an alternative pay region. The location of the drainage pit is determined according to the location(s) of pay region(s) in the vicinity that are deemed to be less suitable for other extraction techniques such as surface mining or in situ recovery methods (e.g., according to geological, technical and/or economic constraints), as will be explained in greater detail below. That is, the region is "unsuitable" for surface mining or conventional SAGD on account of an economic reason. As such, alternative pay regions are regions where that are not suitable for bitumen recovery using surface mining or conventional SAGD techniques—for whatever reason.

The in situ gravity assisted drainage method described herein can incorporate various types of oil recovery techniques, including those utilizing electrical heating, steam, solvent, combustion, gas drive, etc.

It has also been recognized that isotopic and chemical data from formation water samples taken from drill cores can be analyzed to estimate the chemical and isotopic composition of the uncontaminated formation water, according to a process described below. This process enables formation water normally contaminated with drilling fluid to be analyzed without necessarily having access to a sample of such drilling fluid for comparison purposes. Additionally, the analysis has been found to be particularly suitable in a planning stage of the aforementioned in situ gravity assisted drainage method, to more readily allow for assessing the risk of surface discharge of aquifer water, e.g., by using a risk analysis process also described below. In this way, the processes for analyzing formation waters from core samples and assessing the risk of surface discharge of water can be used to determine areas which are less suitable for surface mining but therefore become suitable target alternative pay regions using the in situ gravity assisted drainage method described herein.

In Situ Gravity Assisted Drainage Process

Turning now to the figures, FIG. 1 illustrates a schematic cross-sectional view of an example of a bitumen extraction site 10 (which can employ multiple extraction techniques) that is configured to incorporate an in situ gravity drainage system 12. The in situ gravity drainage system 12 in the example shown in FIG. 1 is installed in a drainage pit 14 that is excavated into an underlying formation 16 that (at least in part) is adjacent to and underlying a layer of bitumen reserves, referred to herein as the "underlying formation" (shown as numeral 16 in FIG. 1). The layer of bitumen reserves, referenced as 18 in FIG. 1, is also referred to herein as "pay" 18. The pay 18 itself underlies and is adjacent to a layer of overburden 20.

The system 12 includes extraction equipment 22 which is suitable to the particular EOR method employed, and one or more inclined horizontally drilled wells 24 directed through the underlying formation 16 and towards an alternative pay region 26. The inclined horizontally drilled wells 24 are drilled using horizontal well drilling techniques with at least some incline in at least some of the well 24. The incline can be provided to access pay 18 due to drilling upwardly from below and/or to provide at least some incline to get drainage from the well. As such, the incline can be of varying degrees including shallow inclines according to the application. It can be appreciated that the pay 18 in at least some implementations is not higher in elevation than the well 24 and thus the incline can be other than upward in such implementations.

In the example shown in FIG. 1, an injector well 24*a* and a producer well 24*b* are shown in a SAGD configuration of the system 12, in that an injector well 24*a* is positioned above a producer well 24*b*. However, as contrasted to a conventional SAGD configuration, the wells 24*a*, 24*b* originate from the drainage pit 14 rather than from surface and are inclined and horizontally drilled from the drainage pit 14. As illustrated in FIG. 1, the alternative pay region 26 is a zone, region, or portion of the layer of pay 18 (i.e. the subsurface formation that includes the bitumen reserve), that would either normally be considered unbookable due to being in a region that is unsuitable for surface mining, e.g., too deep to surface mine or too close to another geological structure (e.g. Karst, river or aquifer, etc.), and is unsuitable for conventional in situ recovery, i.e., too shallow to be feasibly extracted using in situ operations that recover bitumen to ground level (i.e. surface) above the alternative pay region, such as SAGD or CSS. In other implementations, the alternative pay region is unsuitable for recovery by surface mining or conventional in situ techniques on account of economics, i.e. the bitumen from this region would be more economically extracted using the in situ gravity drainage system 12 described herein.

The drainage pit 14 is excavated into an exposed region 30 of the underlying formation 16 at a particular site 32. The exposed region 30 can be part of a naturally occurring outcrop, riverbank, etc., of the extraction site 10. The exposed region 30 could also become artificially exposed by deliberately excavating to the underlying formation 16 to create the exposed region 30. It has been found that the drainage pit 14 is advantageously incorporated into an existing or planned surface mining operation at the site 30, such that surface mining occurs at the site 32 with knowledge of the location of one or more alternative pay regions 26 that can be accessed from the bottom of the surface mine. It can be appreciated that the exposed region 30, when part of a surface mining site 32, can be pre-planned or can be incorporated into an existing surface mining site 32 after determining that there exists a suitable alternative pay region 26 adjacent or near to the site 32. The system 12 can therefore also be referred to as a mine in situ gravity drainage system 12 in applications located within an existing or planned surface mining site 32.

Figure 2:
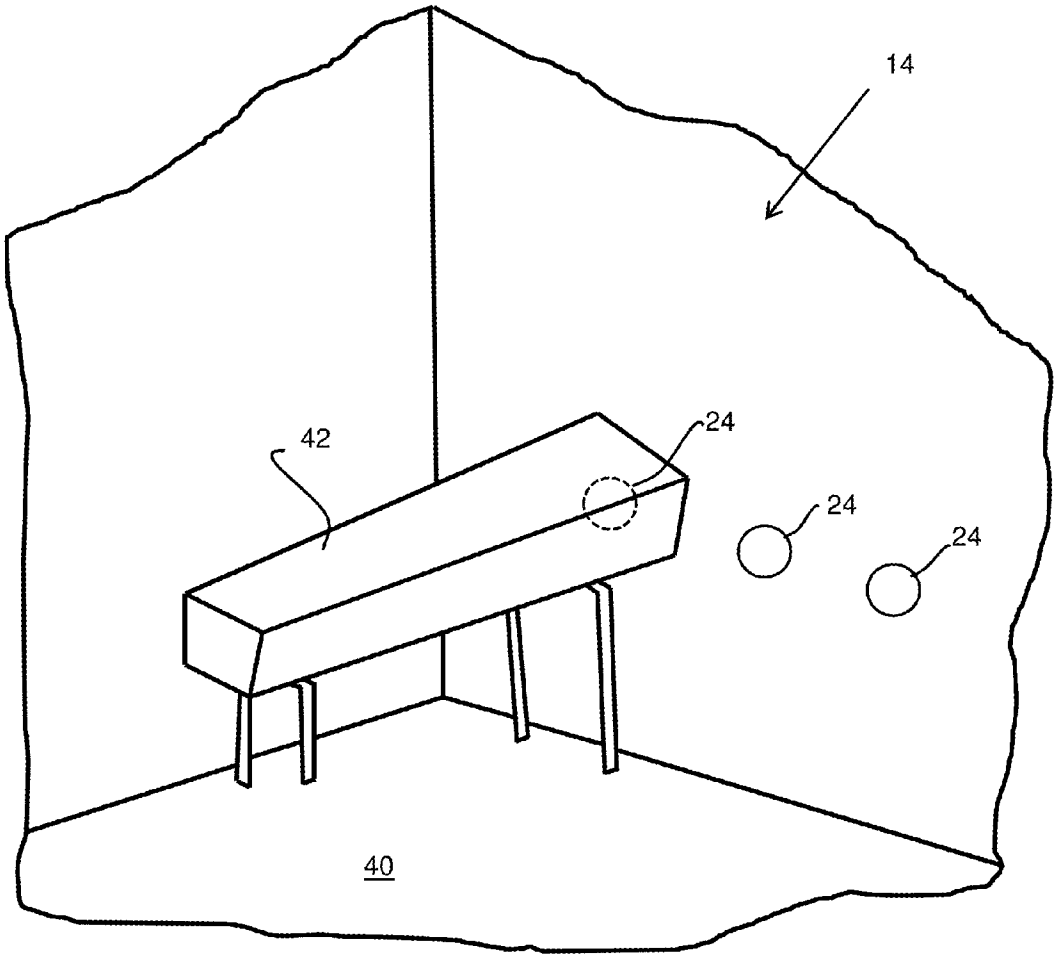
FIG. 2 is an enlarged partial perspective view of a bottom portion of a drainage pit during a well drilling phase.
Figure 3:
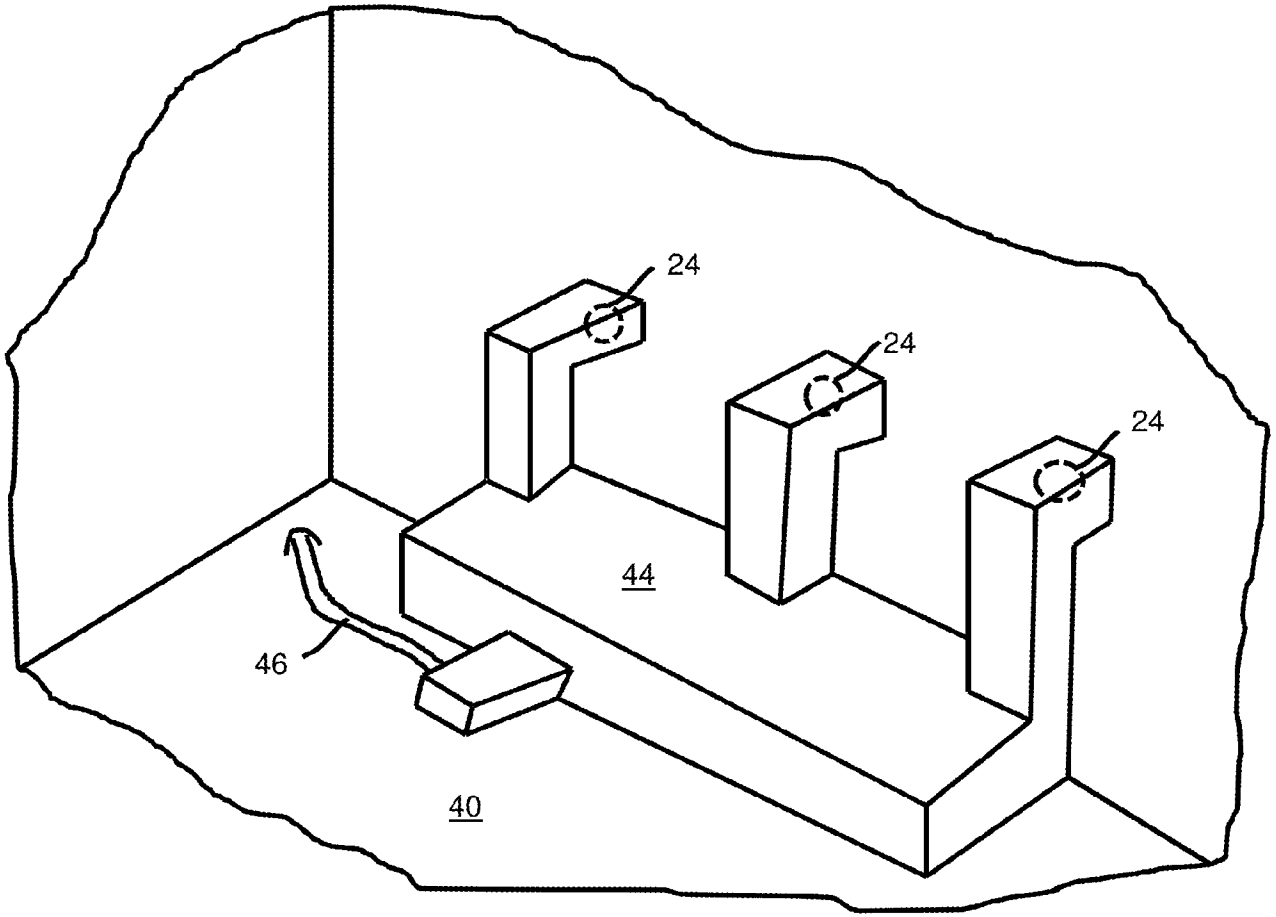
FIG. 3 is an enlarged partial perspective view of the bottom portion of the drainage pit during a production phase.

FIGS. 2 and 3 illustrate partial enlarged perspective views of a lower portion 40 of the drainage pit 14, during drilling and production phases respectively.

After excavating the drainage pit 14, and determining where the horizontal wells 24 will be located (e.g., by conducting typical computer simulations using geological and reservoir data), the corresponding locations on the wall of the drainage pit 14 are prepared for drilling, including providing infrastructure for water and electricity, as is known in the art. The drilling rig is then installed at the location and drilling commences subject to requisite inspections. In the example shown in FIG. 2, a drilling rig 42 is horizontally installed in the drainage pit 14, however, it can be appreciated that various other drilling configurations can be used to achieve the inclined horizontally drilled wells 24, such as directional drilling. The drilling phase includes steps of drilling, then running, and cementing new casing, which are repeated until the drill bit reaches the desired well length, by adding new drill pipe as the well lengthens. The drainage pit 14 is also prepared for pumping drilling fluid down the interior of the drill pipe, which circulates through the drill bit, and returns via the annulus between the pipe and the borehole to be cleaned (i.e. processed to remove drilled particles) and cleaned fluid pumped back down the drill pipe. It can be appreciated that measurement while drilling (MWD) technologies and bends can be utilized to steer the bit and the resultant well 24 in a particular direction. When the drilling is completed, and deemed to be ready for production or injection, production casing is installed, which extends from the entry of the borehole to the end of the well 24 and is cemented in place. Alternatively, the pay section of the well can be lined with a slotted liner or other form of sand control that is not cemented into place. The liner can also utilize packers and inflow or injection control devices (ICDs) that divide the injection or producer wells into segments. The drilling rig 42 can then be moved and used to drill the next well 24 in the drainage pit 14.

In FIG. 2, drilling equipment 42, such as drilling rigs mounted to a wall of the drainage pit 14 in a horizontal configuration, is used to drill the one or more inclined horizontally drilled wells 24 (three being shown in FIG. 2 for illustrative purposes only).

After drilling the wells 24, production equipment 22 for the system 12 is installed in one or more production facilities 44 for operating the one or more inclined horizontally drilled wells 24 as illustrated in FIG. 3. Completing a well for production can involve several steps, as is known in the art. For example, a service rig is moved into location and used to perform a cleanout trip to the total length of the well 24 to ensure that there is no cement or debris left inside the production casing. Alternatively, the well can be completed by the drilling rig after the production casing cement has hardened. To access the target pay 18, perforating is performed to create holes through the casing and cement, which can be performed before or after production tubing is installed in the well 24. Alternatively, the pay section of the well can be lined with a slotted liner or other form of sand control that is not cemented in place. The liner can utilize packers and inflow or ICDs that divide the injection or producer wells into segments. The production tubing is then installed using the service rig. In addition to production tubing, the operator may install downhole instrumentation that can include temperature sensors, pressure sensors or fiber optic cable. Once the tubing has been landed, a wellhead is installed over the production casing.

It can be appreciated from FIGS. 2 and 3 that various configurations and arrays of wells 24 can be employed, depending on the EOR technique being used, the size and location of the alternative pay region 26, and other application-specific considerations such as capacity. The equipment 22 in the production facility 44 shown in FIG. 3 includes one or more outlet paths 46 (e.g., piping) for recovered bitumen to be pumped out of the drainage pit 14 for downstream transportation and/or processing. The bitumen and accompanying fluids that are collected in the drainage pit 14 can be processed at least in part in the drainage pit 14 or can be transported to a treatment facility outside of and away from the drainage pit 14.

FIGS. 4 through 10 illustrate example configurations illustrating various EOR processes that can be used in the system 12.

In most cases, bitumen is extracted using heat generated by a source associated with the EOR process being utilized. For example, various steam-based processes exist, including SAGD, single well CSS, and steam drive.

Figure 4:
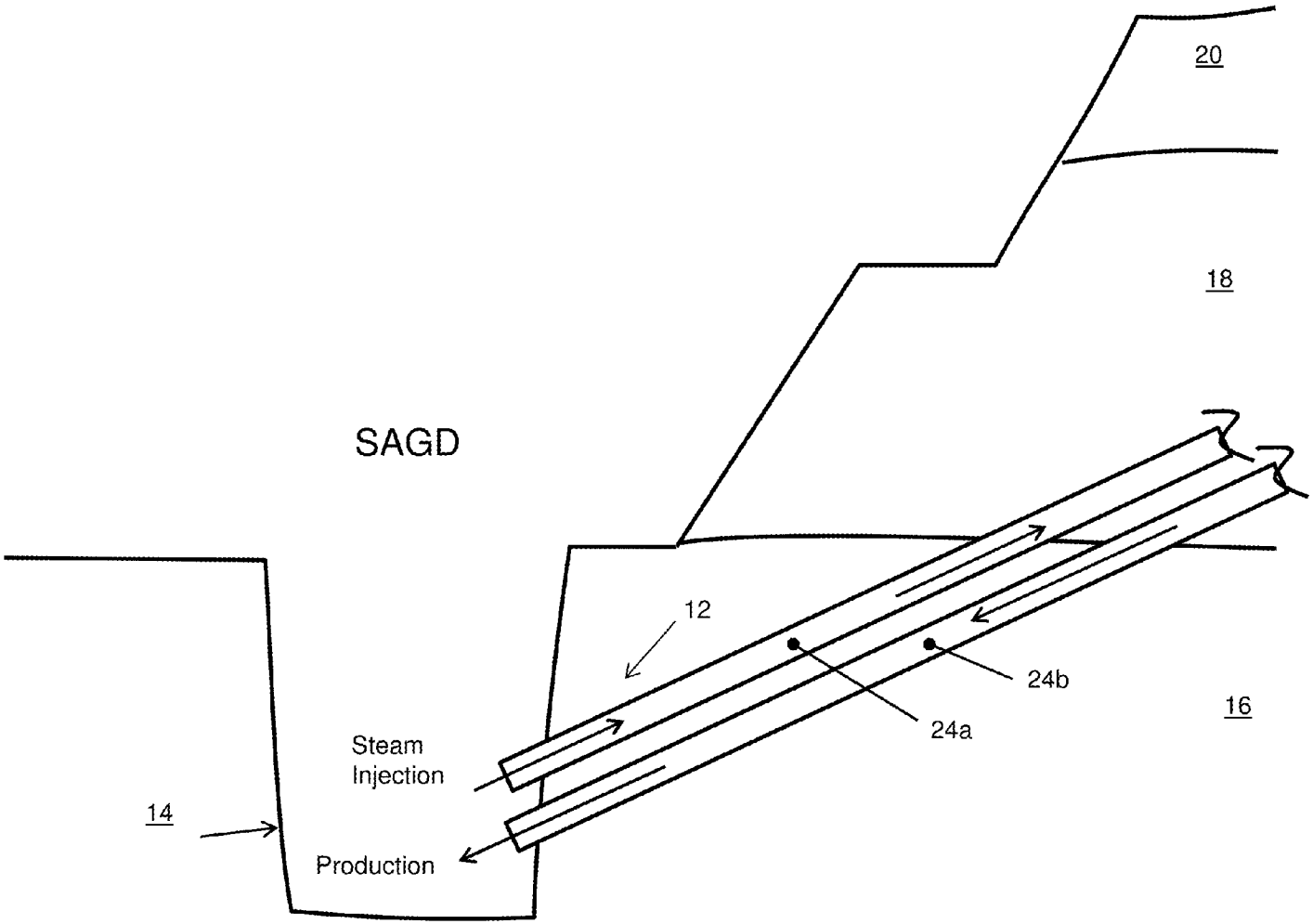
FIG. 4 is a cross-sectional elevation view of a drainage pit incorporating a SAGD oil recovery process showing injection and production phases.

FIG. 4 illustrates a SAGD process that can be deployed in the drainage pit 14 instead of or in addition to other EOR processes such as CSS, electric heating, combustion, etc. Compared to traditional SAGD implementations, in the configuration shown in FIG. 4, an injector well 24*a* and a producer well 24*b* (forming a well "pair" 24*a*, 24*b*) are horizontally drilled from the wall of the drainage pit 14 at an incline rather than directionally drilled from surface. This allows a SAGD configuration to be used at depths that are not traditionally accessible to SAGD well pairs due to limitations on building angles from surface to horizontal, and turning the wells in a desired direction. Otherwise, the SAGD process can be employed according to usual methods whereby steam is injected into the injector well 24*a* and heated bitumen flows towards and into the producer well 24*b* thereafter flowing in to the drainage pit 14. Similar to other EOR processes, the steam injection facilities can be located within or outside of the drainage pit 14.

Figure 5A:
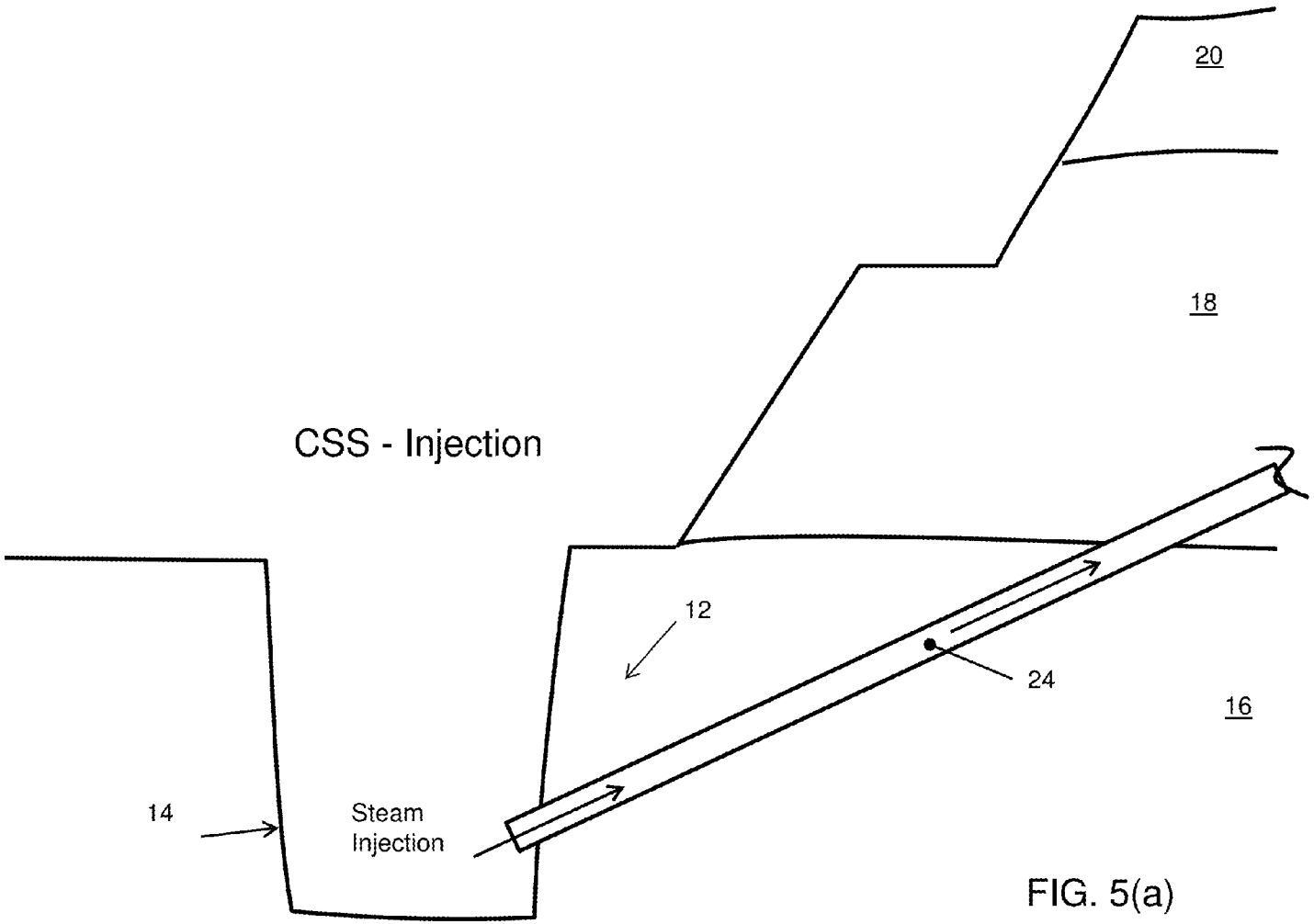
FIG. 5(*a*) is a cross-sectional elevation view of a drainage pit incorporating a cyclic steam stimulation (CSS) oil recovery process during a steam injection phase.
Figure 5B:
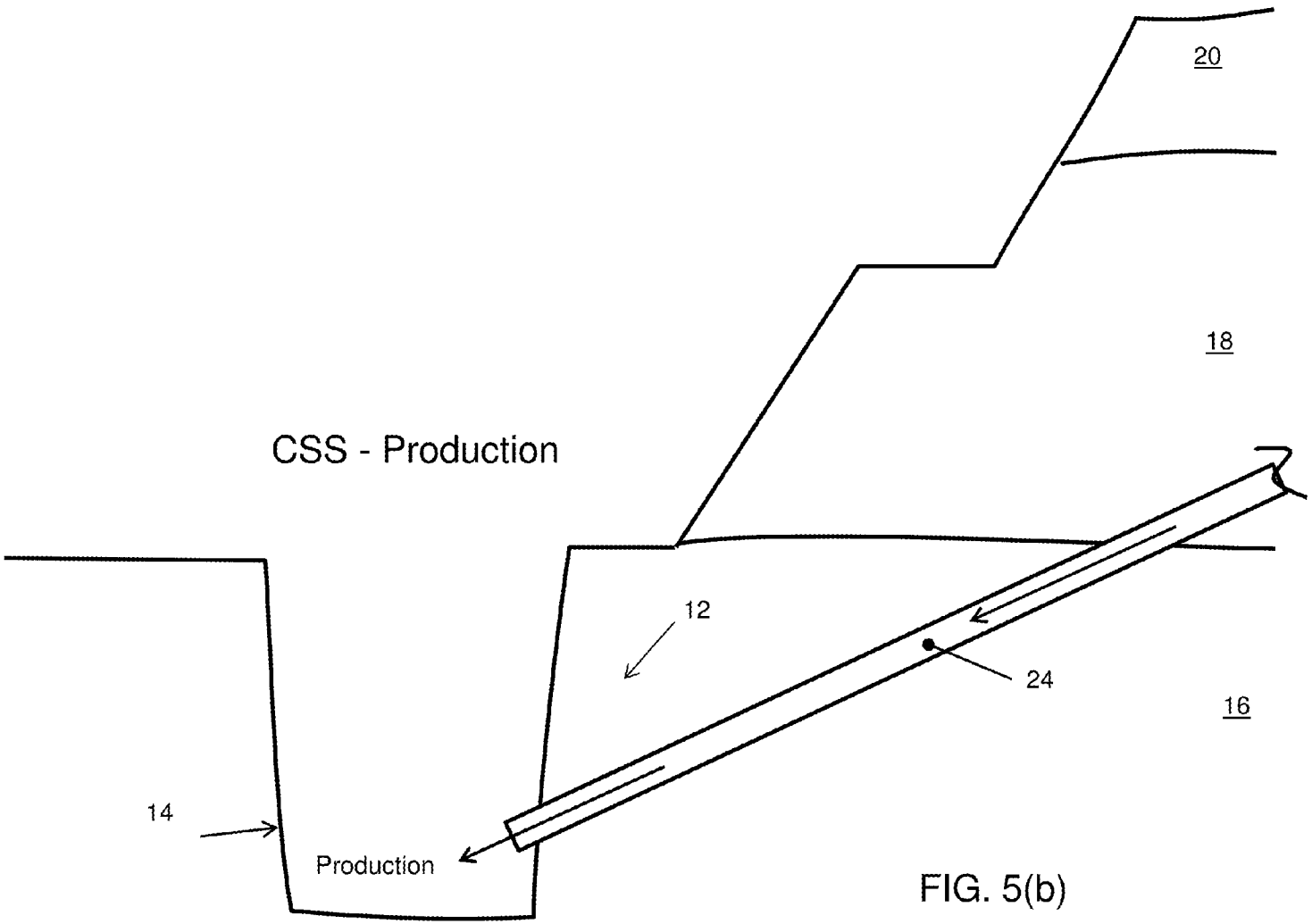

FIGS. 5(*a*) and 5(*b*) illustrate a CSS process, often referred to as the "huff-and-puff" method, that can be deployed in the drainage pit 14. In FIG. 5(*a*), a single well 24 is shown into which steam is injected during a steam injection phase. The steam injection phase involves injecting steam into the well 24 for a period of weeks to months after which the well 24 is allowed to sit for days to weeks to allow heat to soak into the formation containing the pay 18. The production phase, shown in FIG. 5(*b*), follows the soaking phase in which heated bitumen drains from the well 24 into the drainage pit 14, which can employ the use of a pump.

Figure 6:
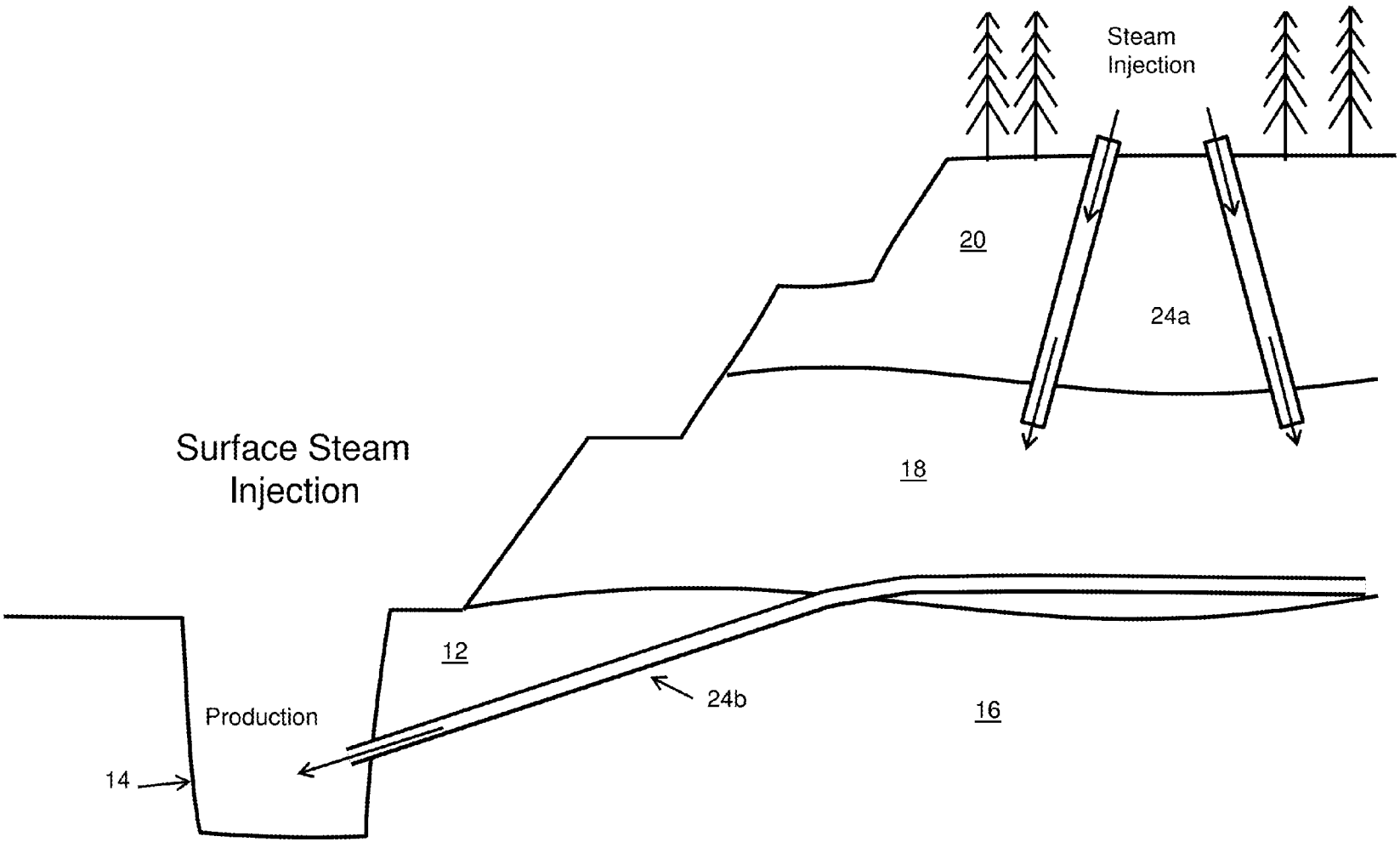
FIG. 6 is a cross-sectional elevation view of a drainage pit incorporating a steam drive configuration utilizing a vertical injector well.

As noted above, the steam injection facilities can be incorporated into the equipment 44 (see FIG. 3) and thus be located in the drainage pit 14, or such facilities can be located outside of the drainage pit 14. For example, as shown in FIG. 6, steam can also be introduced using vertical injector wells 24*a*, to heat the reservoir above a producer well 24*b* in a SAGD configuration. It can be appreciated that steam, solvent, electricity, air (for combustion), etc., which are used in the injection phase of a respective EOR process, could also be added either inside or outside of the drainage pit 14.

Other heat sources can be used to implement an EOR process in the drainage pit 14. For example, FIG. 7(*a*) illustrates a single well electric heating process in which an electrical heat source 49 is used to heat bitumen surrounding a well 24*c* having insulated surface casing. It can be appreciated that since water is conductive, the equipment 22 should be operable to dissipate current from the produced bitumen. Electric heating can utilize direct current (DC), single phase alternating current (AC), or three-phase AC. Three-phase AC power can be chosen for higher power applications where constant torque is desired.

In some implementations, the electrical heat source 49 is provided by an electrical heating system which disposes an electrical heater cable in the well 24*c*. The electrical heater cable includes a wire surrounded by insulation (e.g., mineral insulation) and disposed within a metallic sheath. The wire is electrically coupled to a power source and a controller and, in this respect, is configured to effect heating of the pay 18 surrounding the well 24*c* by conduction. An example of a suitable heater cable is a mineral-insulated ("MI") heater cable, which includes an electrically conducting core surrounded by a metallic sheath (e.g., a 304L sheath) with a mineral insulation layer (e.g., magnesium oxide) disposed between the metallic sheath and the core. In some implementations, the heater cable can include relatively hotter and relatively colder sections by using different materials in different sections of the cable. In this way, different heating rates can be provided for different portions along the well 24*c*.

The heater cable utilized by the electrical heat source 49 can be deployed within a coiled tube and multiple cables can be deployed within such a coiled tube. The cables can be mounted to a support rod for maintaining positioning of the cables. The coiled tube is typically deployed from a reel or other suitable feeding mechanism, which would be positioned within the drainage pit 14.

Figure 7A:
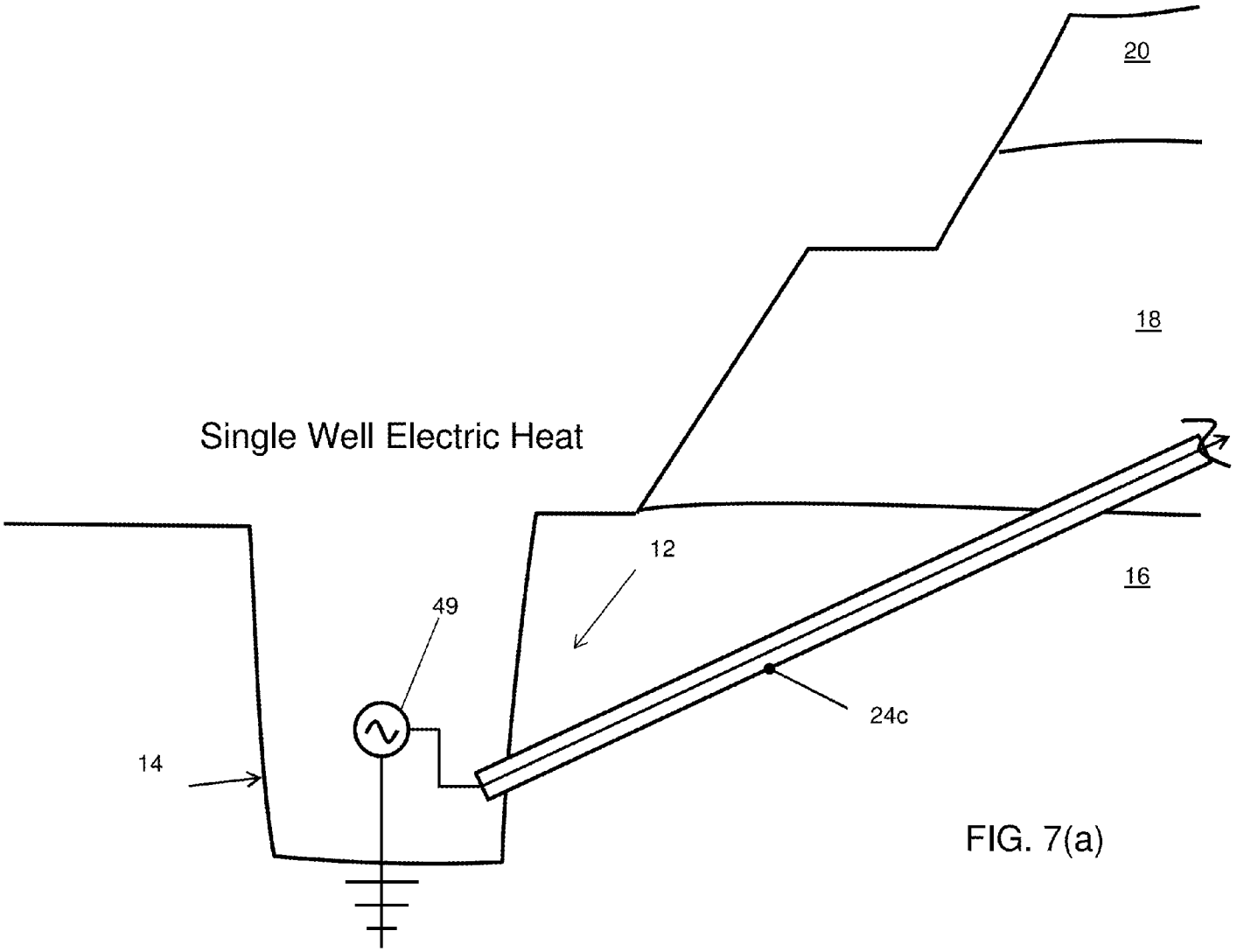
FIG. 7(*a*) is a cross-sectional elevation view of a drainage pit incorporating a single well electric heating oil recovery process.
Figure 7B:
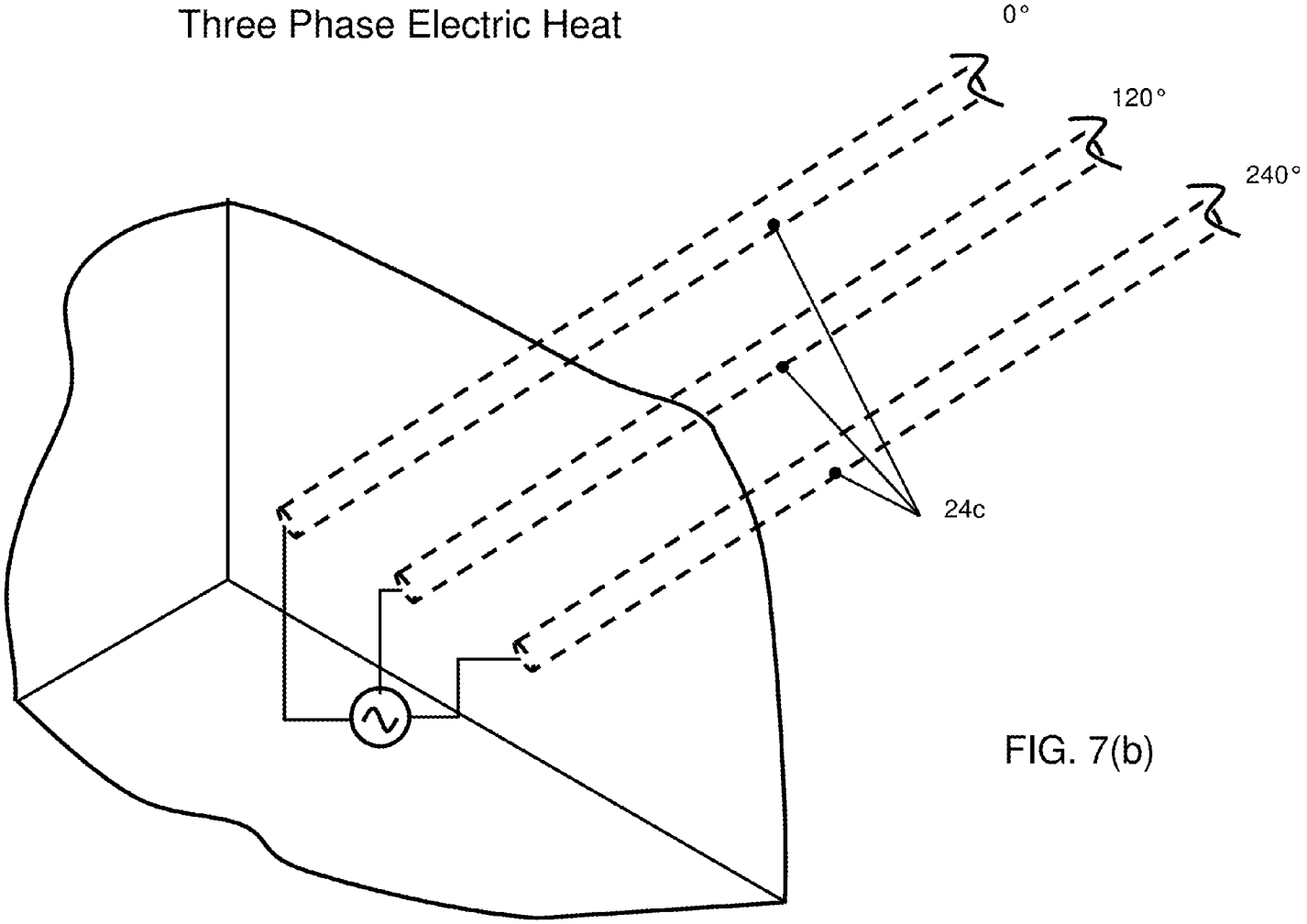

It can be appreciated that while FIG. 7(*a*) illustrates a single well electrical heating configuration which heats the pay 18 near the well 24, other electrical heating based methods can also be employed, for example, inter-well electrical heating which heats the pay 18 in inter-well regions between well pairs as shown in FIG. 7(*b*). As is known in the art, inter-well electric heating applies heating directly to the target formation by relying on current flow between electrode wells and is typically used to heat portions of the pay 18 some distance from the wellbores. In the configuration shown in FIG. 7(*b*), three wells 24*c* having insulated surface casing are each heated using a different electrical phase, e.g., 0°, 120°, and 240° as illustrated. A fourth well can also be included and operated using the 0°/360° phase.

Figure 8:
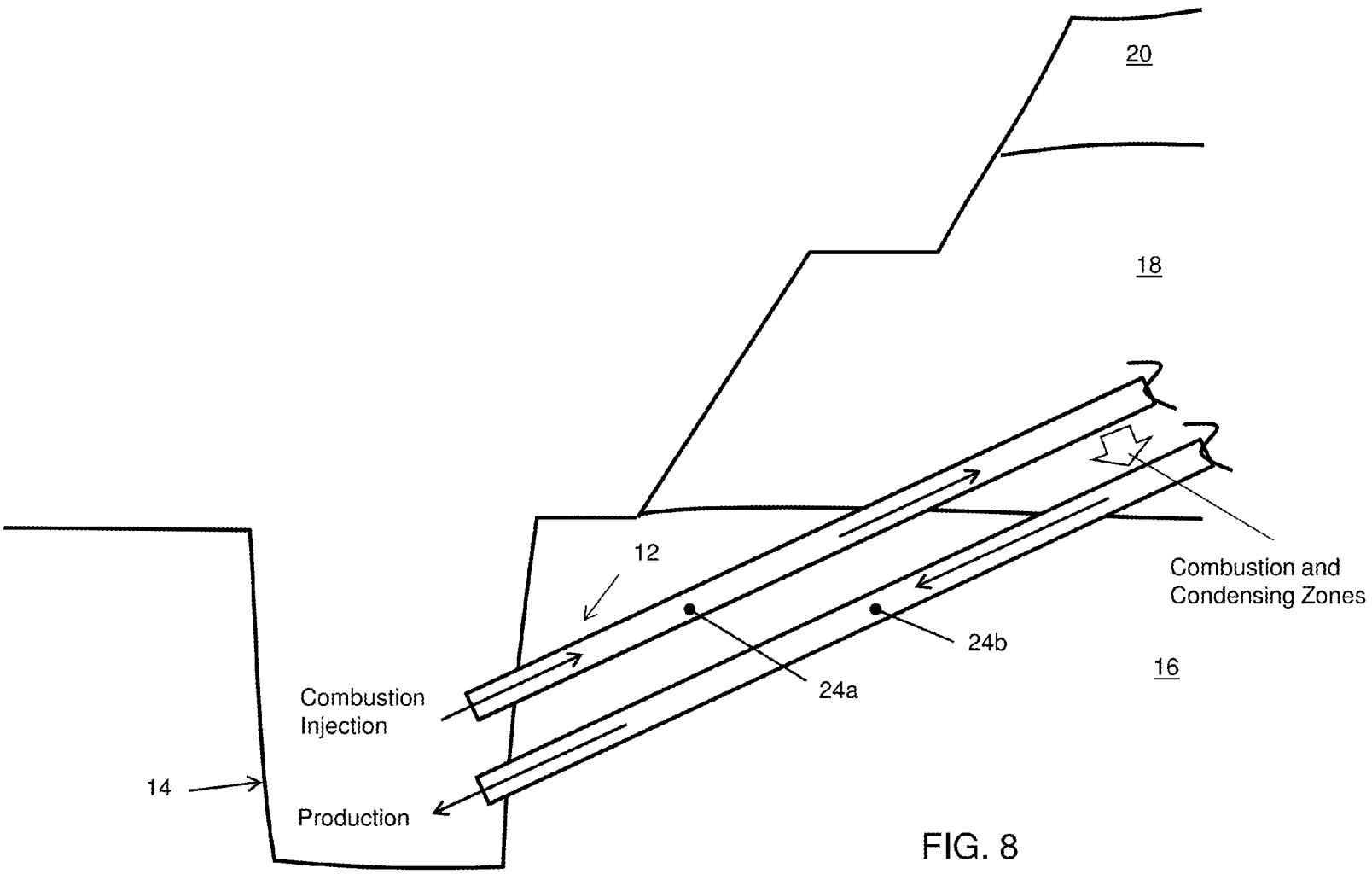
FIG. 8 is a cross-sectional elevation view of a drainage pit incorporating a fuel-plus-air injection or fuel-plus-oxidant injection oil recovery process.

Combustion can also be a source of heat for extracting bitumen. FIG. 8 illustrates a combustion-based process in which the injector well 24*a* is injected with a combustible fuel and oxidant (e.g., air), which is ignited to heat the pay 18 between injector well 24*a* and the production 24*b*, e.g., via combustion and condensing zones as is known in the art.

Figure 9:
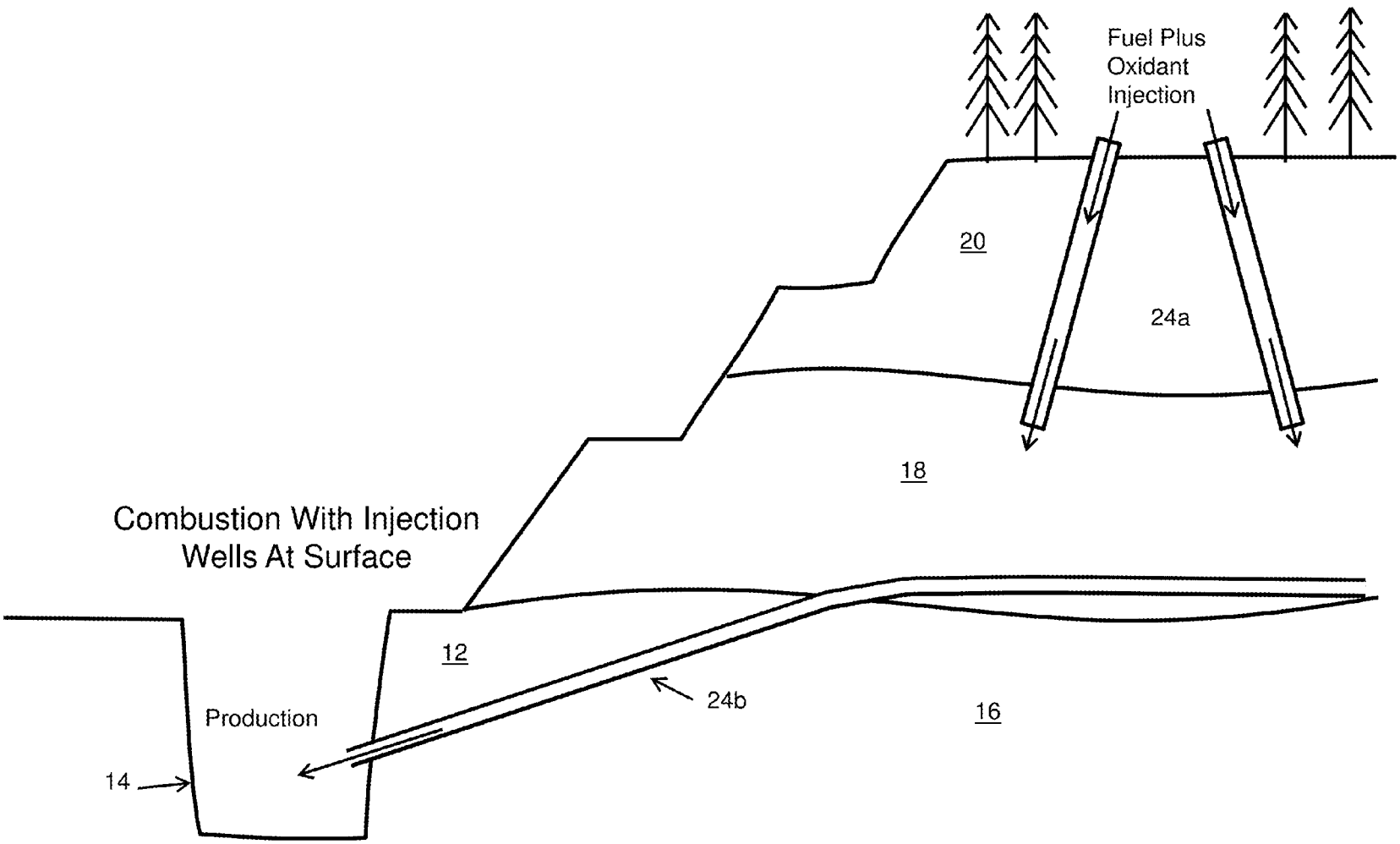
FIG. 9 is a cross-sectional elevation view of a drainage pit incorporating a fuel-plus-air injection or fuel-plus-oxidant injection oil recovery process utilizing one or more vertical injector wells.

FIG. 9 illustrates a combustion-based process in which one or more vertical injector wells 24*a* are used to inject fuel plus oxidant into the pay 18. As illustrated in FIG. 9, the bitumen is produced into well 24*b*, similar to what is show in FIG. 6. It can be appreciated that the configurations shown in FIGS.

8 and 9 can also be used to implement a solvent injection-based oil recovery process, e.g., using propane, butane, $CO_2$, etc.

Figure 10:
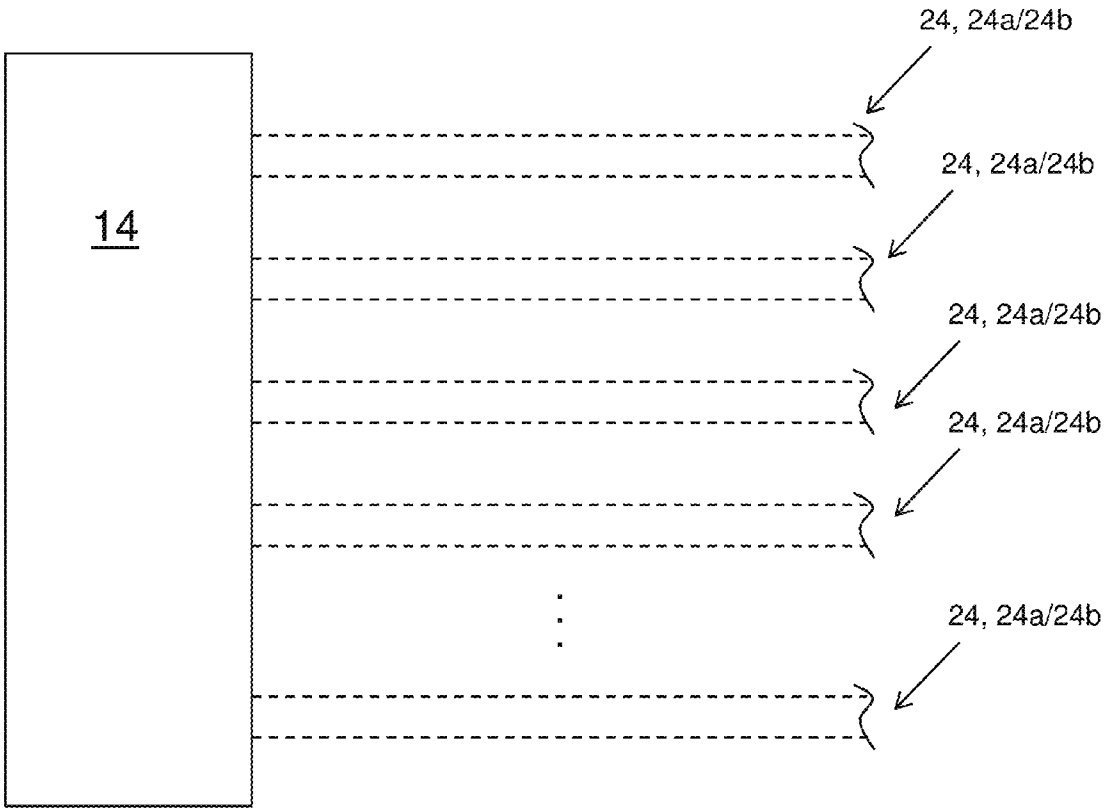
FIG. 10 is an aerial plan view of a drainage pit incorporating multiple wells or well pairs.

As indicated above, any one or more EOR processes can be deployed within/from the drainage pit 14, including combinations of multiple process types. FIG. 10 illustrates a series of wells 24 or well pairs 24*a*, 24*b* that can be deployed along the length of a wall of the drainage pit 14. For example, the drainage pit 14 can include multiple electrically heated single wells 24, multiple well pairs 24*a*/24*b* utilizing SAGD, CSS, combustion, and/or electrical heating, etc.

In addition to the thermal-based processes illustrated in FIGS. 4 to 10, it can be appreciated that non-thermal processes can also be utilized. For example, solvent-based processes can be deployed alone or in combination with one or more thermal processes. Typical solvents include light hydrocarbons such as methane, ethane, and propane; up to heavier hydrocarbon molecules such as naphtha having 5 to 12 carbon molecules.

Carbon dioxide flooding is another example of a non-thermal process that can be used. Various other processes include, without limitation, flue gas flooding, non-condensable gas (NCG), the use of surfactants, alkaline chemicals, microbes, etc. It can also be appreciated that processes can be combined wherein heat is added to solvents, carbon dioxide, or soapy water; or wherein combustion follows steam, etc.

Regardless of the recovery process(es) employed in the drainage pit 14, bitumen along with accompanying fluids (e.g., water, solvent, gases, etc.) are caused to flow through the inclined horizontally drilled wells 24 into the drainage pit 14 to be transported to a treatment facility (or be treated within the drainage pit 14 if applicable). As noted above, injection facilities for which ever process or processes are utilized in the system 12 can be located inside or outside the drainage pit 14 and thus any solvent or other materials can also be injected from inside or outside of the drainage pit 14.

Figure 11:
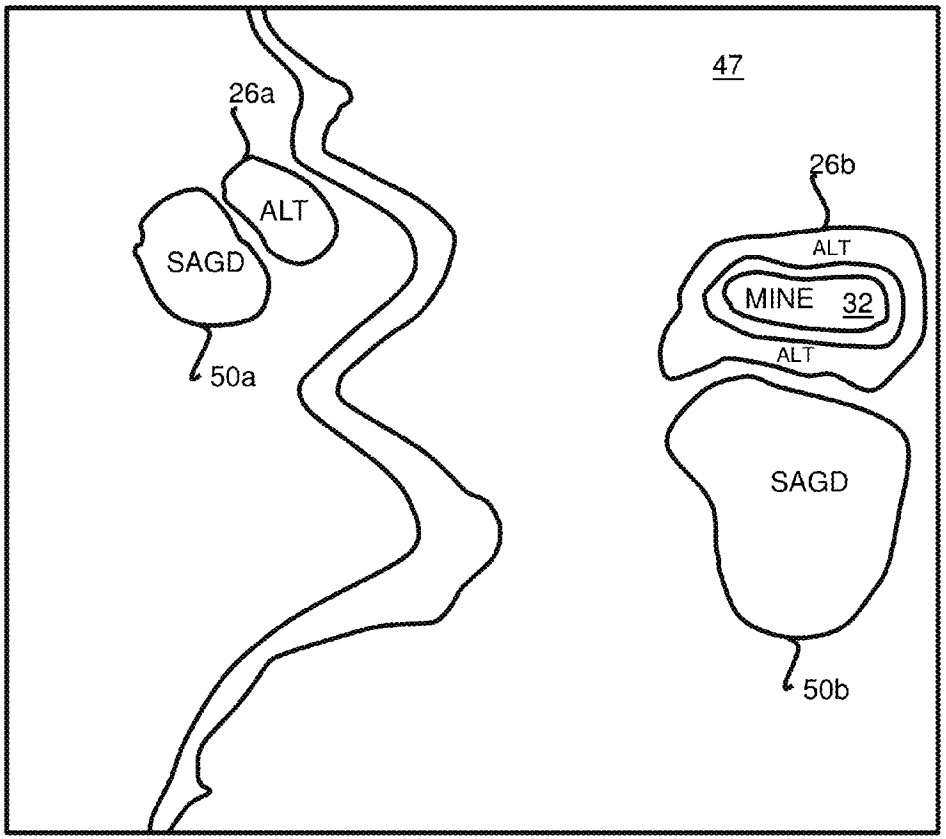
FIG. 11 is a schematic elevation view of a mapping of bitumen pay regions in a geographical area utilizing various extraction methods.

While the system 12 shown in FIG. 1 can be applied to existing sites 32 and/or previously determined or existing exposed regions 30, the system 12 is advantageously utilized to extract pay from alternative pay regions 26 identified when planning sites for yet-to-be extracted reserves. For example, as illustrated in FIG. 11, in addition to mapping 47 out suitable surface mining sites 32 and SAGD sites 50*a*, 50*b* for a geographical area 46, one or more alternative pay regions 26 can be identified and included in the planning phase. In the example shown in FIG. 11, a first alternative pay region 26*a* is identified between a river 48 and a first SAGD site 50*a*. The first alternative pay region 26*a* could also be in an area having a naturally occurring or feasibly accessible exposed region 30 of an underlying formation 16 (e.g., via some overburden excavation) to allow for excavation of a drainage pit 14. A second alternative pay region 26*b* surrounding a mine site 32 is also illustrated by way of example to demonstrate that multiple portions of an alternative pay region 26*b* can be accessed from the same mine site 32 when applicable. For example, the same drainage pit 14 can be excavated to be large enough to reach multiple portions of the alternative pay regions 26*b* by drilling in opposite directions, or multiple drainage pits 14 can be excavated at the mine site 32. Similarly, multiple distinct alternative pay regions can also be accessed from the same mine site 32. It can be appreciated from FIG. 11 that SAGD sites 50 can also be considered in planning alternative pay regions 26 to be exploited, e.g., in order to reach between the mine site 32 and the SAGD site 50, and/or to facilitate or complement the production of the in situ wells 24 due to the potential to reach towards a planned SAGD site 50 and thus contribute to the heating of the reserves in that area. Similar considerations are also applicable to existing or planned sites using other EOR methods such as CSS.

Figure 12:
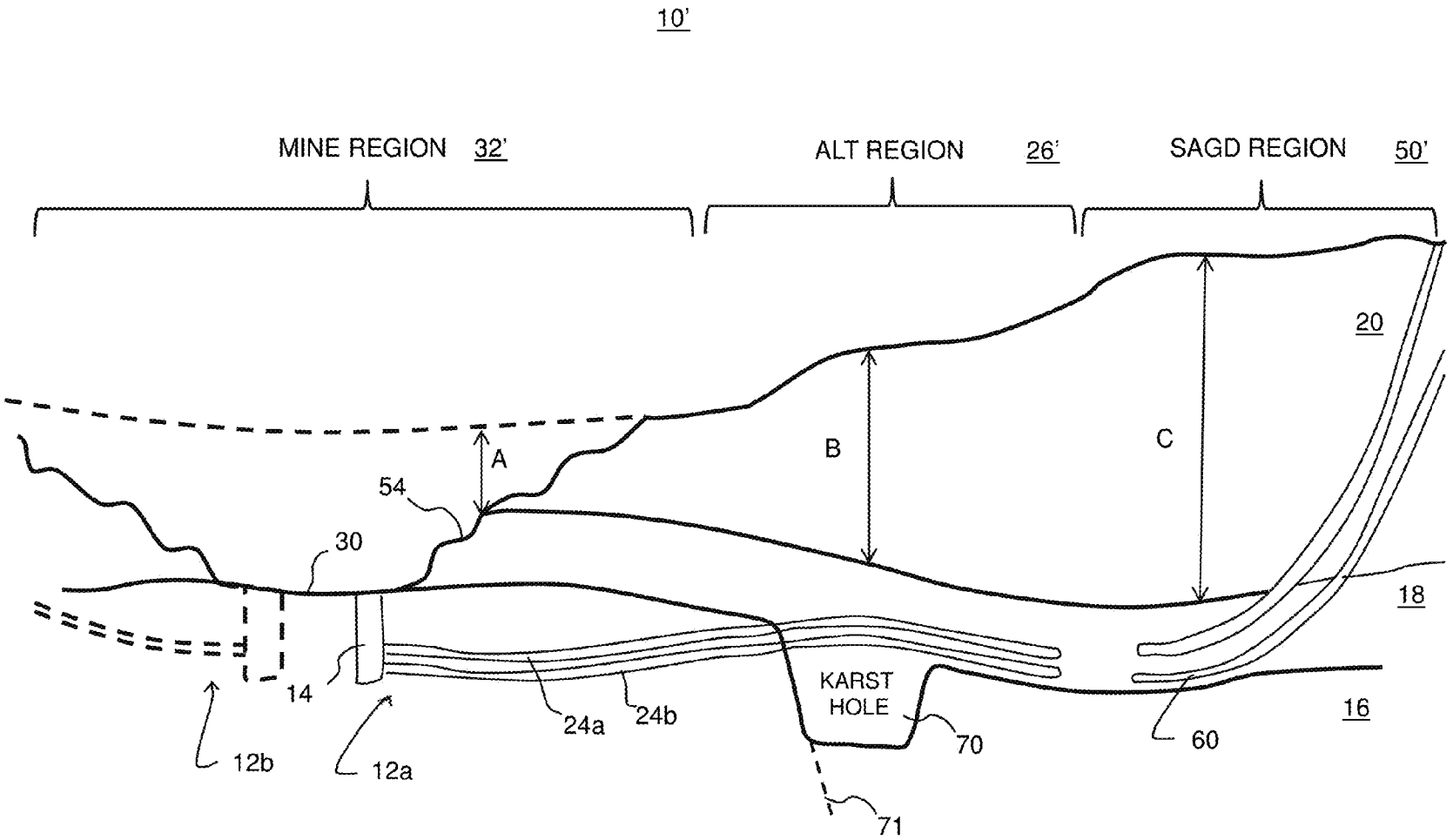
FIG. 12 is a cross-sectional elevation view of a bitumen extraction site for recovering bitumen from an alternative pay region located between a surface mining site and a SAGD site.

FIG. 12 illustrates one example of a bitumen extraction site 10*a* that can be retrofitted to include the system 12 to access alternative pay regions 26, or can be planned such that it incorporates the system 12 at a particular stage of production. In the example shown in FIG. 12, an alternative pay region 26' is identified as being stranded between a surface mine region 32' and a SAGD region 50'. As can be appreciated from this illustration, whereas the mine region 32' includes pay 18 that is beneath overburden 20 having a depth of approximately distance A (e.g., 30-50 m), making the pay 18 suitable and economical for surface mining operations in that area; and the SAGD region 50' includes pay 18 that is beneath overburden 20 having a depth of approximately distance C (e.g. 70 m) or greater, making the pay 18 suitable for in situ recovery; there is a band of pay 18 that is beneath overburden 20 having a depth of approximately distance B (e.g., 30-50 m<B<70 m). When a region of pay 18 is beneath an overburden of distance B, and determined to be unsuitable (or less suitable) for surface mining and in situ techniques, such a region can be considered for recovery using the in situ gravity drainage system 12 described herein, rather than being left behind as being considered unbookable pay 18.

In addition to being considered unbookable due to the depth of the pay 18, the alternative pay region 26' can also be identified as being suitable for the in situ gravity drainage system 12 described herein for other reasons. For example, also illustrated in FIG. 12 is a Karst hole 70. A Karst hole 70 or other Karst feature such as fractures 71 or faults emanating from a Karst hole 70 in the vicinity of the alternative pay region 26' can make the underlying formation 16 unsuitable for high pressure recovery or mining operations by increasing the risk of seepage of gas or fluids to the surface. On the other hand, Karst holes 70 can create areas having a relatively thicker band of pay 18 due to the depression in the formation. Since the system 12 can operate using a low pressure in situ technique, the inclined horizontally drilled wells 24 can be drilled into and through such a Karst feature as illustrated in FIG. 12.

Moreover, since surface mining typically includes the development of several benches 54 to facilitate removal of excavated overburden 20 and pay 18 using excavation equipment (not shown), the alternative pay region 26' can include or otherwise be adjacent or beneath such benches 54, wherein the system 12 enables the recovery of additional pay 18 that would otherwise be considered unbookable in the example shown.

The mine region 32', as illustrated in FIG. 12, can also include multiple drainage pits 14 to access multiple alternative pay regions 26 in different directions. It can be appreciated that as discussed above, multiple sets of one or more wells 24 can also be drilled from the same drainage pit 14.

It has also been recognized that in at least some embodiments, the production of the alternative pay region 26' using the system 12 can also enhance or otherwise complement production of a nearby SAGD site 50 by effectively contributing heat to that region. Such additional heating can therefore contribute to additional recovery in, for example the producer well of a SAGD well pair 24*a*/24*b*. Similarly, less viscous bitumen in the pay 18 that is heated from the in situ operation can also contribute to additional recoveries in one or more of the wells 24 operated in the system 12.

Figure 13A:
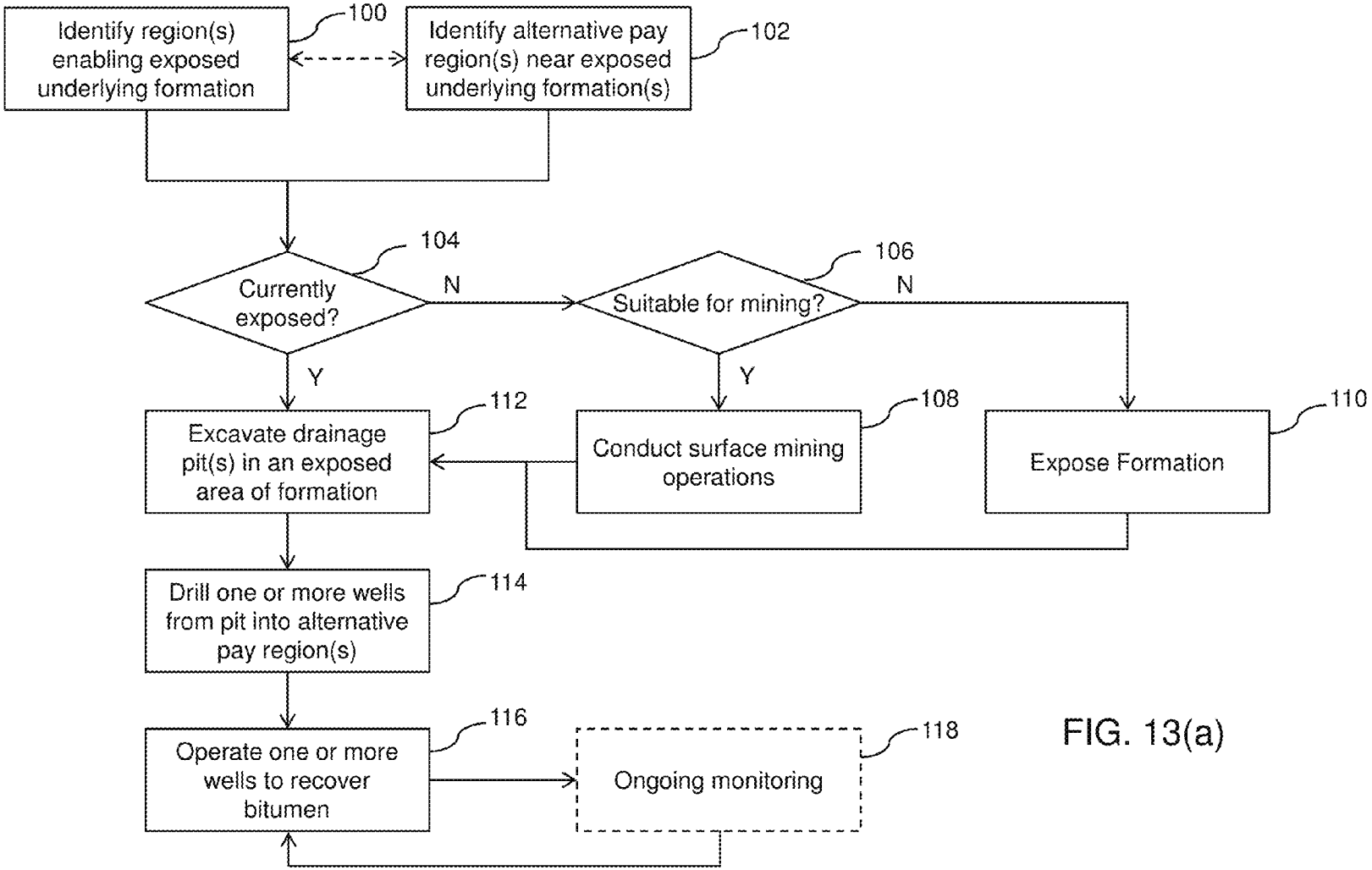
FIG. 13(*a*) is a flow chart illustrating a method for extracting bitumen from a geographical area including at least one alternative pay region.
Figure 13B:
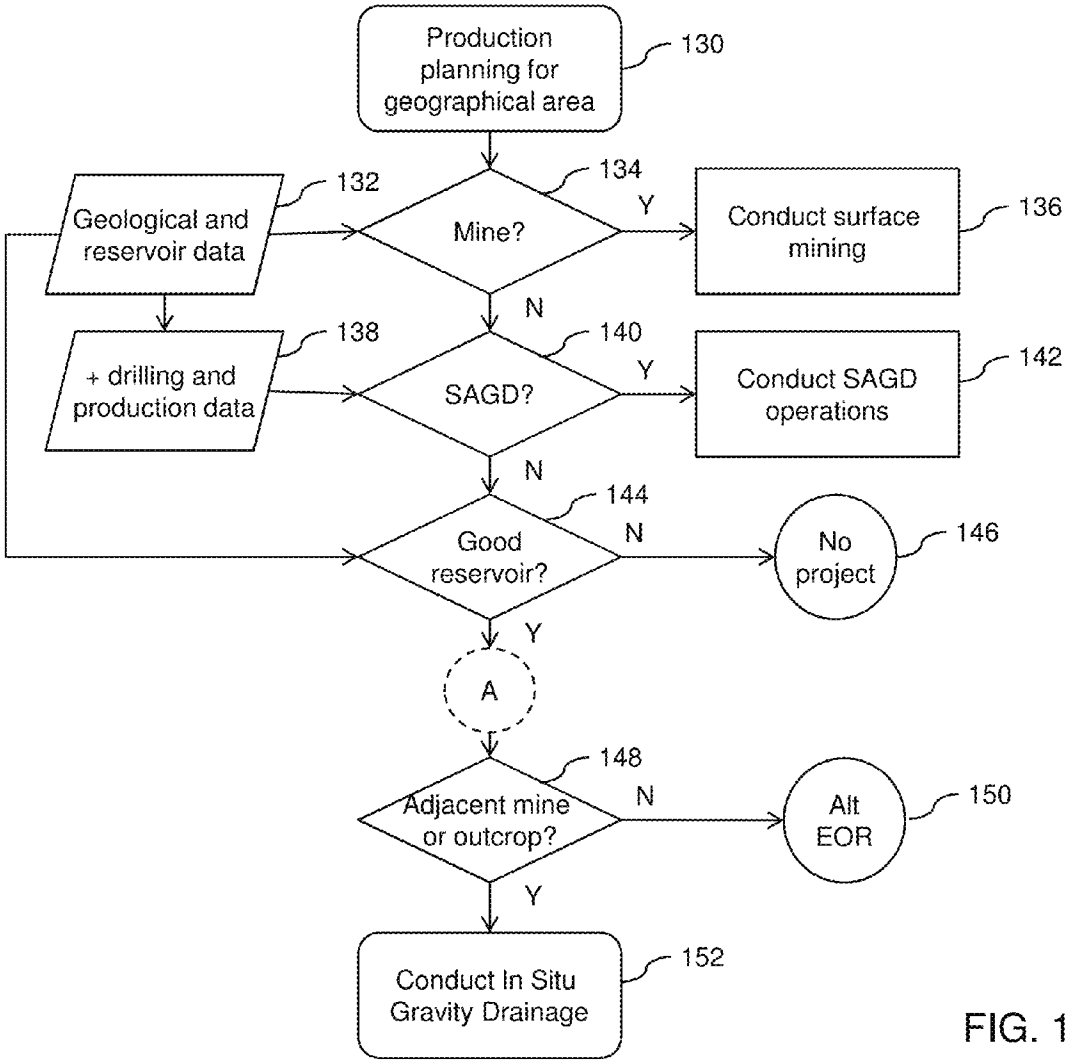

Turning now to FIG. 13(*a*), a flow chart illustrating a method for recovering bitumen from a geographical area is shown, in which the recovery includes bitumen recovered from at least one alternative pay region 26. At step 100 regions are identified that already include or can be excavated to include (e.g., subsequent to mining) an exposed region 30 of the underlying formation 16 that enables the excavation of a drainage pit 14. At step 102, the geographical area near the potential areas of exposed underlying formation 16 are analyzed to identify alternative pay regions 26, e.g., those that are reachable using the system 12 and would not otherwise be bookable pay 18 recovered using surface mining or surface-based EOR techniques.

It can be appreciated that steps 100 and 102 can be initiated as part of a planning phase prior to bitumen recovery using one or more traditional techniques (i.e. prior to surface mining and/or in situ production), as a post-recovery phase to conduct additional recovery, or in identifying alternative pay regions 26 outside of a traditional bitumen recovery plan (e.g., to take advantage of naturally occurring outcrops or recover additional pay 18 at or near otherwise unsuitable regions). It can also be appreciated that, as shown in FIG. 13(*a*), steps 100 and 102 may be conducted in parallel or serially in any order depending on the information and planning methodology employed.

At step 104 it is determined whether or not the potential exposed region(s) of underlying formation 16 is/are currently exposed. For example, an exposed area can already exist in a current surface mining site 32 or in a naturally occurring outcrop. If the potential exposed area 30 is not yet exposed, e.g., currently has at least some overburden 20 or other material above the area 30, it is determined at 106 whether or not the area including and surrounding the potential exposed area 30 is suitable for surface mining. If not, the overburden is excavated at 110 to expose the layer of underlying formation 16. It can be appreciated that step 110 can include areas near geological features that are unsuitable for surface mining or in situ techniques, and which require at least some excavation of the overburden 20 in order to further excavate a drainage pit 14.

If the potential exposed area 30 is deemed at step 106 to be suitable for surface mining, surface mining operations are conducted at step 108, which would eventually allow for a region of the underlying formation 16 to be exposed.

Step 112 is conducted once there is a suitable exposed area 30, at which time a drainage pit 14 is excavated. Once the drainage pit 14 has been created, one or more wells are horizontally drilled from the drainage pit 14 at an incline along at least a portion thereof and into the alternative pay region(s) 26 at step 114. It can be appreciated that in step 114, equipment 22 suitable to the chosen in situ gravity drainage technique is selected and installed. For example any one or more of the EOR processes shown in FIGS. 4 through 10 can be utilized, including combinations of multiple process types.

At step 116 the one or more wells 24 are operated from within the drainage pit 14 to recover the additional bitumen reserves from the alternative pay region(s) 26. As shown in dashed lines in FIG. 13(*a*), ongoing monitoring of the conditions in the drainage pit 14 and/or wells 24 can also be conducted, e.g., to determine, using the isotopic and chemical analyses described below.

FIG. 13(*b*) illustrates an example of a planning method for extracting bitumen in a geographical area which begins at step 130. Geological and reservoir data 132 associated with the geographical area is obtained and used to determine at step 134 whether or not the geographical area currently being assessed is surface mineable. If so, surface mining operations can be conducted at step 136. If not, the geological and reservoir data 132 and drilling and production data 138 is used in step 140 to determine if the geographical area currently being assessed can be accessed using a SAGD method. If so, SAGD operations can be conducted at step 142. If not, the geographical and reservoir data 132 is further utilized at 144 to determine if the geographical area currently being assessed nevertheless has what can be considered good pay and is thus a good reservoir. If not, the process results in no project at 146. If so, isotopic and chemical data from formation water samples taken from drill cores can optionally be analyzed at A (see flow chart in FIG. 16) to estimate the chemical and isotopic composition of the uncontaminated formation water, which may further include assessing risk using a risk matrix as discussed below. At step 148 it is determined whether or not the geographical area being currently assessed is adjacent a mine or an outcrop. If not, an alternative (alt) EOR process can be considered at 150. However, if the geographical area currently being assessed is adjacent a mine or outcrop, the in situ gravity drainage method described herein is conducted at step 152.

Analyzing Isotopic and Chemical Data from Formation Water Extracted from Drill Core As discussed above, as part of the planning stages for recovering bitumen from a geographical region, for example in steps 100 and 102 of FIG. 13, various analyses can be conducted, to determine the suitability of certain sub-regions for corresponding extraction techniques, such as surface mining and traditional in situ techniques such as SAGD. In assessing the suitability of such sub-regions, various other unsuitable regions can also be identified, wherein the above-noted in situ gravity drainage method can be used to recover bitumen from alternative pay regions 26.

One such analysis, described below, enables water samples taken from drill core to be analyzed to estimate the chemical and isotopic composition of uncontaminated formation water, even though the water sample from the drill core is contaminated by drilling fluid. That is, because the water sample is taken from a drill core, the sample of water is contaminated by drilling fluid that was used to extract the drill core using drilling equipment. However, the techniques described herein can be used on such drill core water samples to determine characteristics of the formation water in an uncontaminated state. As will be explained in greater detail below, the characteristics of the formation water, e.g., chemical and isotopic composition, thus determined can be used to assess the risk of surface discharge of aquifer water in particular geographical regions and thus assist in identifying regions of pay that are more suitably recovered using the in situ gravity drainage method described above.

It can be appreciated that the method for estimating the chemical and isotopic composition of formation water extracted from core samples can be used in any application where knowledge of the composition of the formation water is desired, and the utilization of the method in identifying alternative pay regions 26 is but one illustrative example of an application of this technique.

The following method permits the prediction of the chemical composition of formation water based on an analysis of contaminated formation water samples taken from a drill core, without requiring information about the drilling fluid, also referred to a drilling "mud". The method predicts isotopic and chemical composition of formation water based on an analysis of isotopic and chemical data from the contaminated formation water samples, and information on the local meteoric water line.

The technique described herein addresses the problem that formation water from a drill core are typically contaminated by drilling mud that is used during drilling. Conventionally, in order to estimate the chemical composition of formation water from such contaminated formation water samples, a sample of the drilling mud that was used had to be analyzed for its chemical composition. Based on the analysis of the drilling mud, data from the contaminated formation water samples were corrected to yield characteristics of the formation water. An issue with this technique is that drilling mud samples are often not retrieved or stored for later use. Moreover, often it is not known at the time of taking a core sample that the core will be used for a later formation water analysis. Another technique to analyze the chemical composition of formation waters is to drill an observation well. However, observation wells require additional time and resources, which is not always feasible.

The technique described herein allows contaminated formation water samples to be analyzed to estimate the chemical and isotopic composition of the uncontaminated or "virgin" formation water, without requiring a sample of the drilling mud that was used. As described in greater detail below, the technique recognizes that the intersection of a line fitted to a plot of particular isotopes and the meteoric water line can estimate the decontaminated isotopic composition of the formation water, without having to rely on a separate analysis of the drilling mud. Given that an estimate of the isotopic composition of the uncontaminated formation water is now known, the total dissolved solids (TDS) as well as various other chemical components can be plotted against the $\delta^{18}O$ line to estimate uncontaminated TDS values, i.e. where the TDS line has a value of $\delta^{18}O$ that is equal to the uncontaminated $\delta^{18}O$ level.

Figure 14:
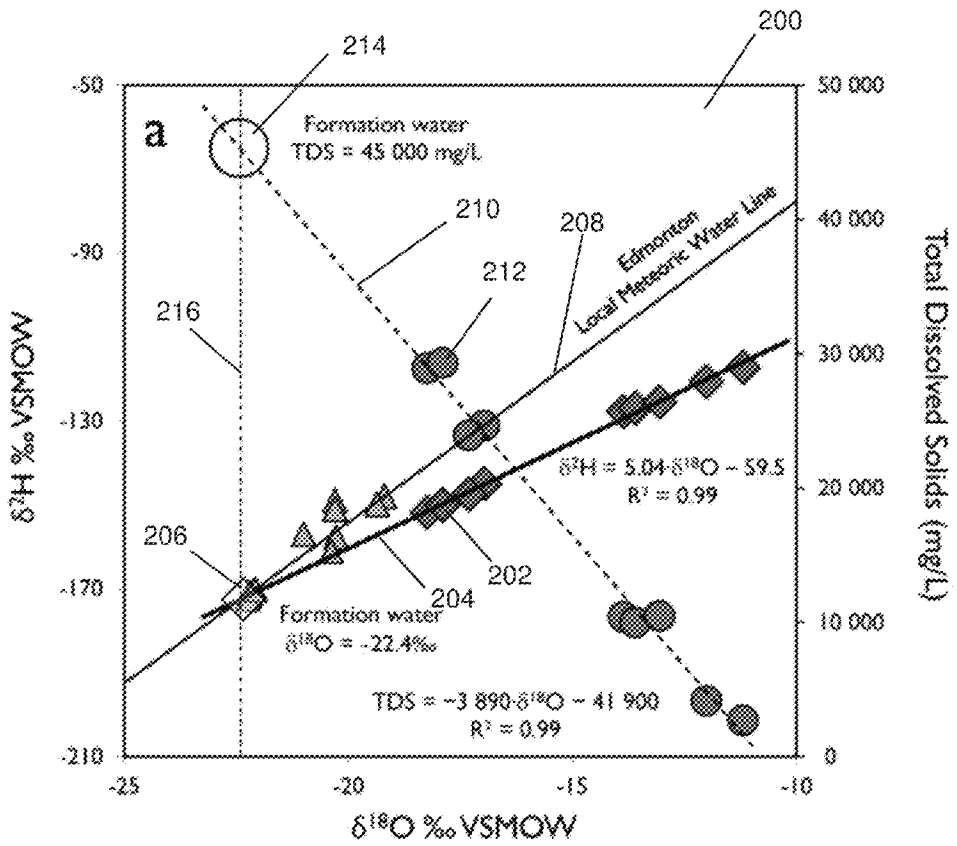
FIG. 14 is a plot of formation water isotope composition and total dissolved solids (TDS) for a formation water sample.

An example of the formation water analysis is illustrated in a plot 200 shown in FIG. 14. Contaminated formation water samples are analyzed for $\delta^{18}O$ and $\delta^{2}H$ isotopes, yielding several data points 202 (diamonds plotted in FIG. 14) to enable construction of an isotope mixing line 204 which defines $\delta^{18}O$ and $\delta^{2}H$ isotope compositions for mixtures of formation fluid and drilling mud. It can be appreciated that the contaminated formation water of the drill core is assumed to include a mixture of both formation fluid and drilling mud. $\delta^{18}O$ concentration within the formation water is then estimated based on the intersection 206 of the isotope mixing line 204 with a local meteoric water line 208. As illustrated in FIG. 14, to obtain the isotope mixing line 204, the $\delta^{18}O$ and $\delta^{2}H$ isotopes are plotted (e.g., diamonds 202) on an X-Y axis and a straight line is fitted though these data points 202 and extended until it crosses the local meteoric water line 208, which is predetermined and typically well established in many geographical areas. The point of intersection 206 marks the decontaminated isotopic composition of the formation water.

Based on the estimated $\delta^{18}O$ concentration within the formation water, other chemical composition information of the formation water within the drill core can be obtained based on the chemical composition information of the contaminated formation water samples taken from the drill core. Such information can be defined by another mixing line 210 constructed from measurements of the chemical composition characteristic of various samples of the contaminated formation water samples taken from the drill core, such as the TDS content. In FIG. 14, TDS data points 212 are plotted and used to form the TDS mixing line 210. The intersection 214 of the TDS mixing line 210 and a line 216 perpendicular to the X-axis which crosses through the intersection 206 of the water line 208 and the isotope mixing line 204 gives an estimate of the TDS in the virgin formation water, in this example approximately 45 000 mg/L.

Figure 15:
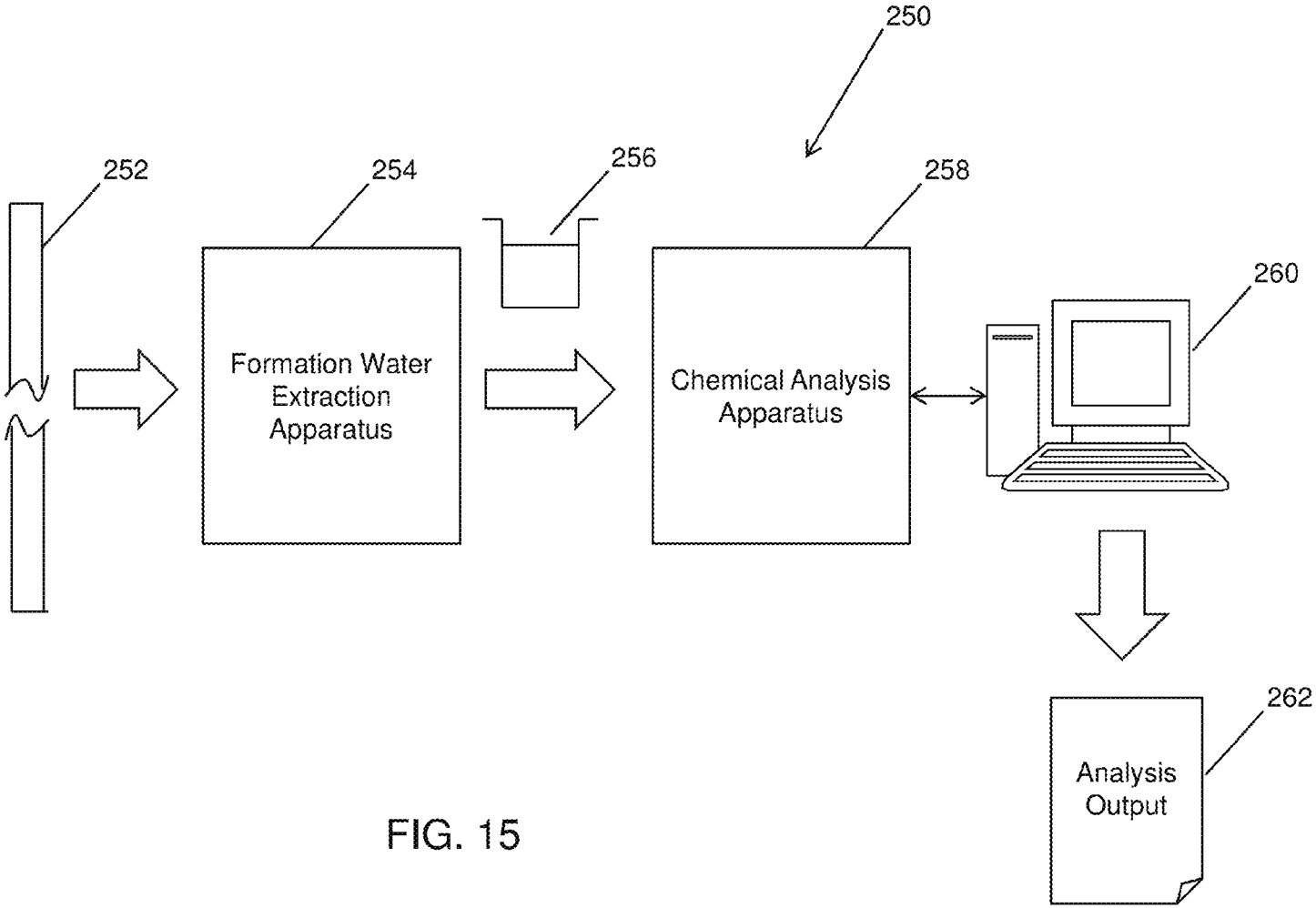
FIG. 15 is a schematic diagram of a system for analyzing a core sample to determine chemical characteristics of uncontaminated formation water.

FIG. 15 illustrates a schematic diagram of an example of a formation water analysis system 250. In the example shown in FIG. 15, the system 250 includes formation water extraction apparatus 254, which operates on a core sample 252 as is known in the art, to obtain a contaminated formation water sample 256. The contaminated formation water sample 256 is then analyzed by chemical analysis apparatus 258 such as a chromatography system and an autotitration system, to determine the data points that can be analyzed by a computing device 260 in order to generate an analysis output 262 such as a plot, report, etc. It can be appreciated that the chemical analysis apparatus 258 and computing device 260 are delineated as shown in FIG. 15 for illustrative purposes only and such devices may be integrated in other configurations, e.g., wherein the computing device 260 forms a portion of the chemical analysis apparatus 258.

Figure 16:
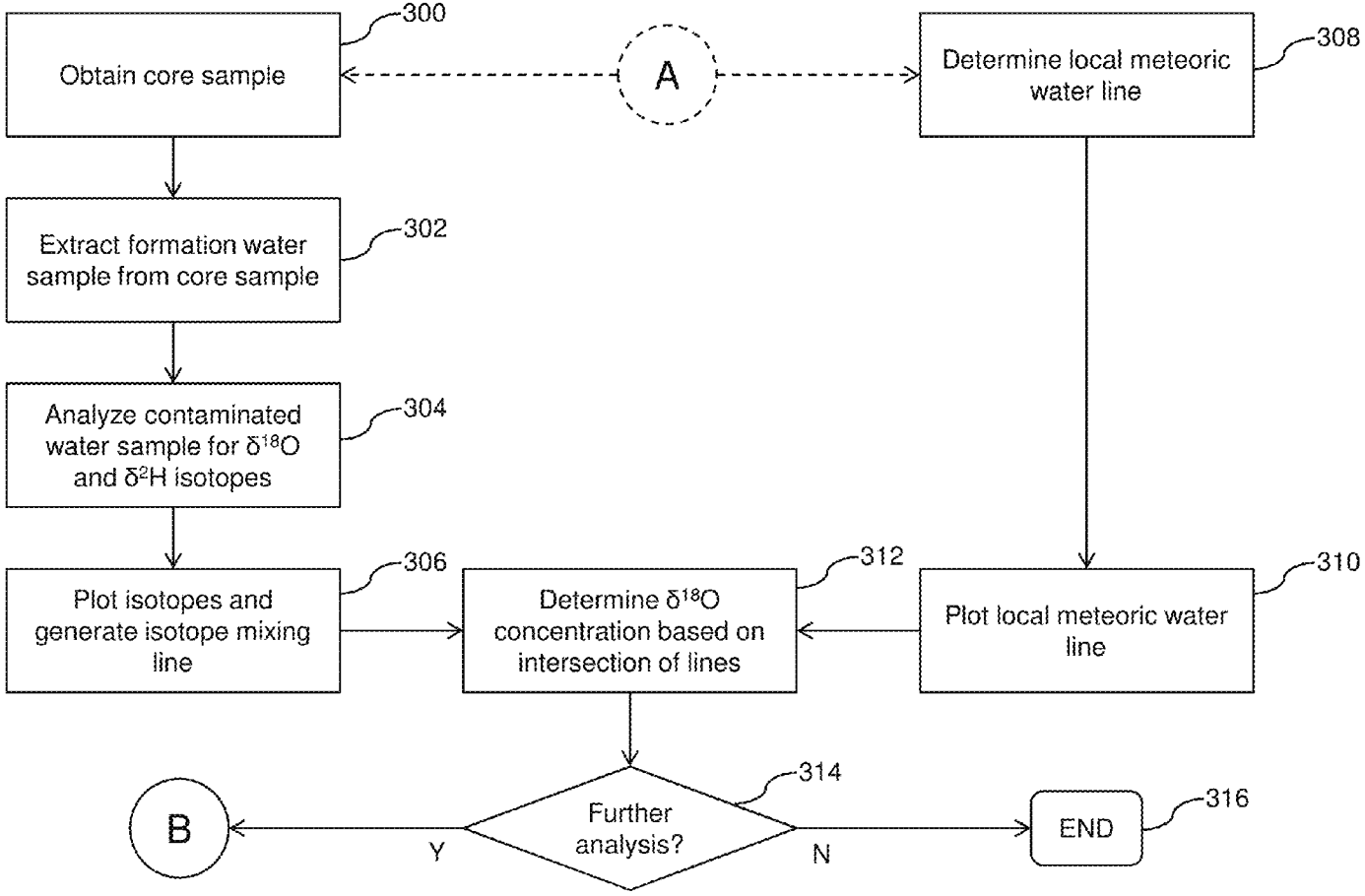
FIG. 16 is a flow chart illustrating a method for determining stable isotope composition from contaminated formation water extracted from a core sample.

FIG. 16 illustrates a method of analyzing formation water extracted from a drill core sample to estimate stable isotope composition of the uncontaminated formation water. As shown in dashed lines in FIG. 16, the method of analyzing formation water may be performed in connection with a planning process for determining alternative pay regions 26 by following "A" in FIG. 13(*b*). At step 300 a core sample 252 is obtained and contaminated formation water is extracted from the core sample 252 at step 302 using the extraction apparatus 254. The contaminated formation water is then analyzed at step 304 to determine the $\delta^{18}O$ and $\delta^{2}H$ isotopes that can be plotted at step 306 in order to generate the isotope mixing line 204. Additionally, the local meteoric water line 208 is determined at step 308. The local meteoric water line 208 can be determined at the time of conducting the chemical analysis, or can be predetermined and stored in the computing device 260 or chemical analysis apparatus 258. For example, tables of local meteoric water lines can be pre-stored for subsequent access according to a location that can be associated with the particular core sample 252 being analyzed. The local meteoric water line 208 is plotted at 310, which enables $\delta^{18}O$ concentration to be determined in step 312 based on the intersection 206 of the isotope mixing line 204 and the local meteoric water line 208 as shown in FIG. 14. This intersection 206 can be plotted as illustrated in FIG. 14, or provided in another form as an output, e.g., as an item in a report.

As discussed above, further analyses can be conducted using the contaminated formation water sample 256, for example, to determine TDS content. At step 314, it is determined whether or not such further analyses are to be conducted. If not, the process ends at 316, e.g., by storing and/or outputting results. If further analyses are to be conducted, a further process can be initiated at A, which begins in the flowchart shown in FIG. 17.

Figure 17:
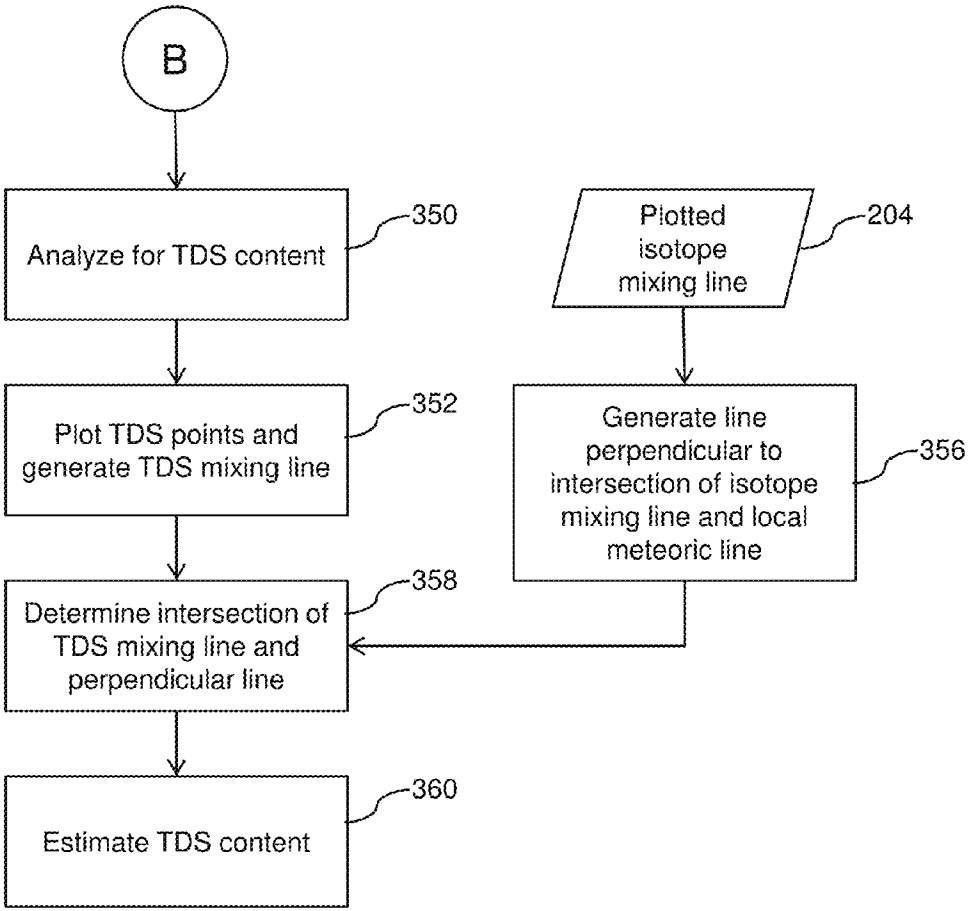
FIG. 17 is a flow chart illustrating a method for determining TDS from contaminated formation water extracted from a core sample.

Turning now to FIG. 17, a process is illustrated for determining TDS from the extracted contaminated formation water sample 256. At step 350 the contaminated formation water sample 256 is analyzed for TDS content, which enables TDS data points 212 to be plotted in order to generate a TDS mixing line 210 as shown in FIG. 14. As shown in FIG. 16, with an isotope mixing line 204 having been generated, a line 216 perpendicular to the intersection of the isotope mixing line 204 and the local meteoric water line 208 is generated at step 356 to enable the intersection 214 of this perpendicular line 216 and the TDS mixing line 210 to be determined at 358, which enables the TDS content to be estimated at step 360. It can be appreciated that the results of the further analysis shown in FIG. 17 can also be plotted as shown in FIG. 14, stored for subsequent use, or output in a report or as another form of data.

As illustrated in FIGS. 14 and 17, the analysis of the contaminated formation water sample 256 as described above can be used to determine the TDS concentration and the stable isotope composition of the uncontaminated formation water in oil sands reservoirs. The technique described herein utilizes two end-member mixing relationships between the stable isotope compositions of drilling fluids and formation waters from mechanically extracted formation water samples 256 to calculate the formation water TDS, $\delta^2H$ and $\delta^{18}O$ values. This technique provides an inexpensive and robust ability to characterize the properties of reservoir formation waters, which takes advantage of the ubiquity of drill core samples 252, while not requiring drilling mud samples. The ability to characterize aqueous fluids within bitumen-saturated reservoirs advantageously enables measurement of aqueous fluid properties that are often found to not be easily obtained by other sampling methods. The methodology described herein provides a tool to understand the origin and movement of reservoir water due to natural groundwater flow, or to anthropogenic influence by steam injection.

The oil sands of northeastern Alberta, Canada, are among the largest energy resources in the world, and contain heavy oil and bitumen reserves. Of the three major Alberta oil sands deposits, the Athabasca Oil Sands Region (AOSR) is the largest and shallowest, permitting both surface mining and in-situ recovery near Fort McMurray, Alberta, Canada. The Athabasca oil sands deposits are primarily hosted within the Early Cretaceous McMurray Formation. The hydrogeology of these heavily biodegraded reservoirs is distinct from conventional petroleum systems due to the relatively shallow reservoir depths and a primarily local nature of most groundwater systems in the Athabasca region. However, recent observations also suggest upward flow of saline groundwater from the underlying Devonian karst system, resulting in heterogeneity in McMurray Formation water TDS across the AOSR.

Oil sands reservoirs include a largely unconsolidated mineral phase, typically consisting of quartz sand with minor inter-bedded shales. Pore space in the reservoir is filled with bitumen and water in varying proportions throughout the reservoir. Water saturation increases toward the bottom of the reservoir through a gradual oil-water-transition-zone that is considered to be the location of greatest biodegradation within the reservoir. Below the oil-water-transition-zone, the McMurray Formation is water saturated, and this zone is occasionally described as the "basal water sands."

Figure 18:
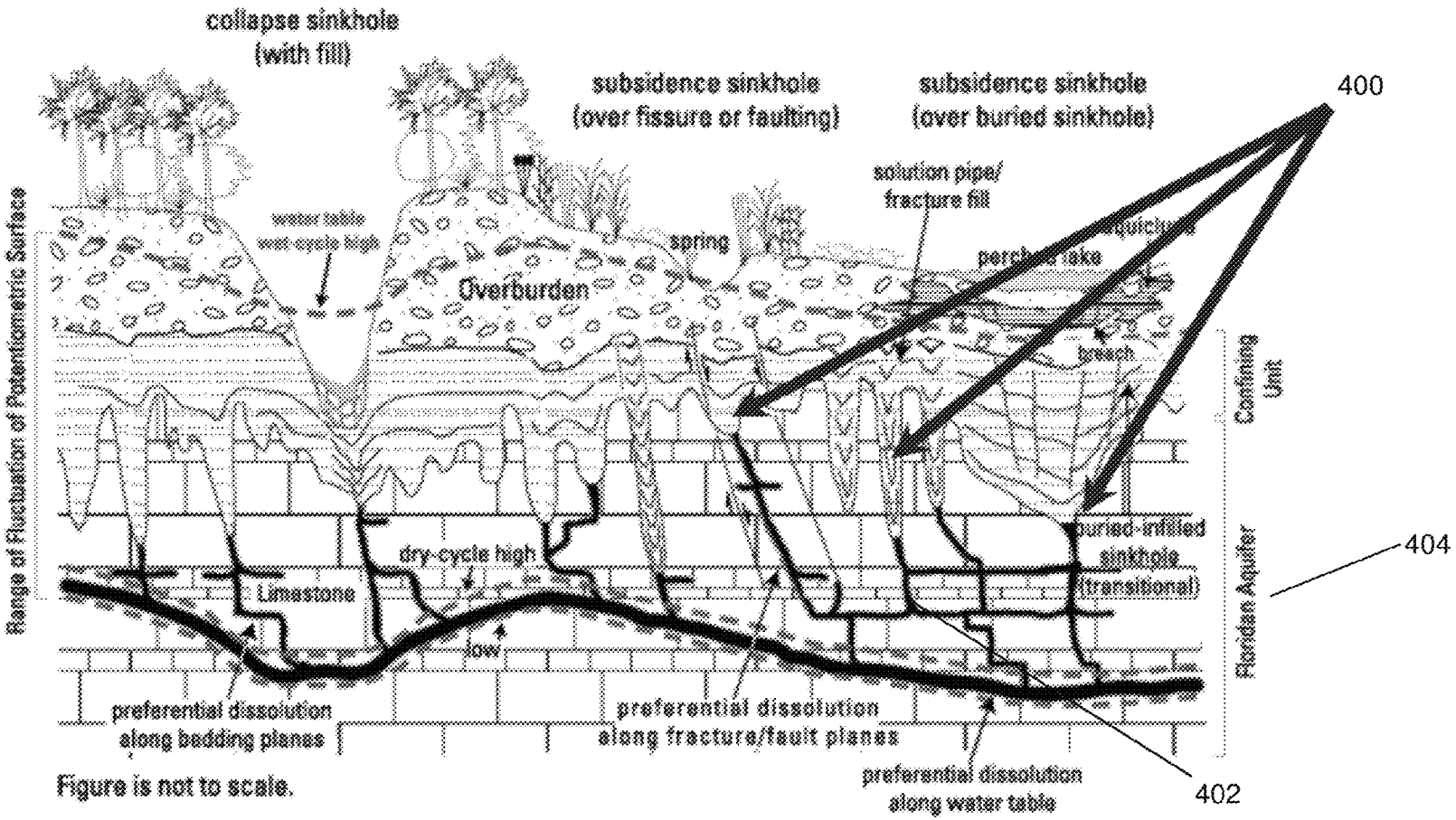
FIG. 18 is a schematic cross-sectional view of an example of karst hydrogeology.

Recent development of in situ technologies that utilize steam to extract bitumen from reservoirs that are too deep to surface mine has created a need for detailed understanding of the hydrogeological systems associated with reservoir development. FIG. 18 illustrates karst hydrogeology wherein sinkholes 400 are linked to sub-surface regions via conduits. Karst features that are small are known to be difficult to detect. However, even small Karst features can create preferential pathways to the surface. For example, a small fracture of only a few meters across can cause an influx of up to thousands of cubic meters per hour. As such, unknown Karst features can be particularly problematic. As shown in FIG. 18, it can be seen that a preferential dissolution 402 along faults below the sink holes 400 can create a conduit that provides a pathway between an aquifer 404 and the ground. Water entering the ground can cause further dissolution of the limestone.

Accurate characterization of the ratio of bitumen to water in a reservoir is important to economic recovery of oil sands resources using in situ extraction technology. SAGD and CSS have been the most commonly employed in situ extraction technologies in Alberta during the development of these oil sands resources. Both of these techniques extract petroleum from the subsurface by heating the reservoir to high temperatures (e.g., >200° C.) by injecting steam into the reservoir. In SAGD, however, if the steam chamber penetrates the water-saturated portion of the reservoir, steam preferentially flows toward the water-saturated section, decreasing the efficiency of extraction by mobilizing heat away from the bitumen.

Geophysical tools that use electrical resistivity to determine bitumen and water saturation are sensitive to the salinity of formation waters. It can be difficult to obtain an accurate measure of formation water salinity in oil sands reservoirs. Water saturation in oil sands systems is typically calculated according to Archie's law, which relates the conductivity of a fluid saturated rock to the conductivity of water, which is directly related to its dissolved ion content and composition. Typically, regional salinity estimates from published literature, or at most the salinities of formation waters in one or two observation wells, are used for calibration of petrophysical tools over a large lease area. However, the TDS values of water in the McMurray Formation are considered to be highly variable over small geographic areas, and these variations in salinity can generate incorrect estimates of water saturation within the reservoir based on electrical resistivity measurements. Commonly, exploration and appraisal wells do not permit accurate determination of water chemistry because of low water saturation in the reservoir and significant invasion by drilling fluids.

Traditionally, one particularly powerful use of isotope hydrogeology is in determining the source of water in a groundwater system. By examining the relationship between $\delta^2H$ and $\delta^{18}O$ values in water, it is possible to delineate water sources, and identify processes that can have affected groundwater through its history. Waters of meteoric origin plot on the Global Meteoric Water Line, GMWL. Waters condensed and precipitated at warmer temperatures generally have higher $\delta^2H$ and $\delta^{18}O$ values than waters condensed and precipitated at colder temperatures, while the linear relationship observed between $\delta^2H$ and $\delta^{18}O$ in precipitation remains approximately consistent through all temperature ranges.

In the present method, a stable isotope approach is utilized for determining TDS and stable isotope ratios of formation water in oil sands reservoirs. The method measures selected properties of formation water 256 that has been extracted from drill core 252, e.g., by mechanically squeezing the formation water 256 from the same drill core material that is regularly used for determining the organic geochemistry of bitumen. The method corrects for the impacts of drilling fluid on formation water measurements to provide both TDS contents and stable isotope compositions ($\delta^{18}O$, $\delta^2H$) of the in situ formation waters.

The present method was evaluated against drilling mud samples, using the same core samples 252, the experimentation being discussed below.

Formation water data from three oil sands wells from different locations within the Athabasca region are evaluated in the following discussion.

Four drilling muds were obtained from oil sands drilling operations. These mud samples were not taken from the same wells from which formation waters 256 were extracted from core 252 in this study, but were obtained from other similar drilling operations in the region.

Formation waters 256 squeezed from core materials and drilling fluids were found to be rich in particulate matter that required clean-up before introduction of water samples into the analytical instruments. Samples were centrifuged to remove suspended matter, and then decanted.

Hydrogen and oxygen isotope ratios were then determined. $\delta^2H$ and $\delta^{18}O$ values were normalized using internal laboratory water standards. Water isotope ratios are reported in delta notation relative to the international VSMOW reference material:

$$\delta^2H \text{ or } \delta^{18}O(‰)=[(R_{sample}/R_{standard})-1]\times 1000 \quad [1]$$

where R represents the measured ratio of $^2H/^1H$, or $^{18}O/^{16}O$.

Accuracy and precision of $\delta^{18}O$ and $\delta^2H$ measurements are generally better than ±0.1‰ and ±1.0‰ (1σ) respectively for replicate measurements of 50 laboratory standards.

An analysis of concentrations of major cations (Na, K, Ca, Mg) was completed, and a chromatography system was used for major anion concentration analysis (Cl, $SO_4$). Laboratory alkalinity (determined as bicarbonate) was determined using an autotitration system. Total dissolved solids were calculated for each sample by taking the sum of the concentrations of major cations and anions in each sample.

Samples from three representative wells from three different locales within the Athabasca oil sands region were used to demonstrate the present method in determining TDS contents and stable isotope compositions of reservoir water. The reservoirs ranged in thickness from ten to thirty meters, and within each reservoir up to ten individual water samples from different depths were obtained and analyzed for stable isotope ratios and geochemical parameters.

The measured TDS values in extracted formation water from the first well were highly variable, and there was found to be no determinable correlation between TDS or stable isotope compositions observed with depth in the reservoir.

The second well also had much variability in measured formation water TDS values, and there was found to be no determinable correlation between TDS or stable isotope compositions observed with depth in the reservoir.

Formation water from the third well had the lowest TDS values of the three investigated wells, but there was found to be no determinable correlation between TDS or stable isotope compositions observed with depth in the reservoir.

Drilling fluids are considered complicated mixtures of water and chemicals from different sources, and the chemical composition of mud is not typically recorded in oil sands drilling operations. Geochemistry and stable isotope compositions of four mud samples measured in this study were used. These were, however, not the same drilling fluids used during completion of any of the three wells in this study, and the data are included to demonstrate that these fluids do not generally plot on the local meteoric water line 208.

To assess the chemical and isotopic composition of in situ reservoir formation water and to determine the impact of drilling fluids on measured water samples, both $\delta^2H$ and TDS were plotted against $\delta^{18}O$ values for all samples from each of the three wells (e.g., similar to what is shown in FIG. 14). The $\delta^{18}O$ and $\delta^2H$ values were closely correlated in each system, displaying a straight line with a distinct slope plotting to the right of the local meteoric water line 208. The example drilling mud samples plot near the far right end of these mixing lines. This linear trend of isotope compositions is interpreted as a two end-member mixing line between original formation waters that plot on the local meteoric water line 208 and drilling fluids that plot to the right of the local meteoric water line 208. In each of the three wells, the relationship between $\delta^2H$ and $\delta^{18}O$ of all formation water samples was a linear trend ($R^2$ values from 0.790 to 0.996) that intercepted the local meteoric water line 208 within the range of isotope values that have been previously published for waters in the McMurray Formation.

During drilling, mud penetrates the borehole and the extracted drill core. However, because bitumen is hydrophobic, it retards the drilling mud from completely obscuring the in situ formation water signal. Hence, the fluid samples obtained from drill core represent mixtures composed of variable proportions of drilling mud and formation water. Evidence for water samples representing variable mixtures between drilling mud and formation water is based on the following observations:

1. The stable isotope ratios of groundwater from published observation wells in the McMurray Formation plot close to the local meteoric water line 208, suggesting that waters within the reservoirs should also plot approximately on the local meteoric water line 208.

2. Measured drilling fluids are enriched in $\delta^2H$ and $\delta^{18}O$ compared to formation water obtained from drill core and to published McMurray Formation water data. These drilling fluids plot to the right of the local meteoric water line 208, suggesting that drilling fluid constitutes the $\delta^2H$ and $\delta^{18}O$ enriched end-member of the mixing line, to the right of the local meteoric water line 208.

3. Formation water samples from core segments of a given well formed a linear trend in $\delta^2H$ $\delta^{18}O$ space that intercepts the local meteoric water line 208 within the range of water isotope compositions that have been previously published for the McMurray Formation.

4. The stable isotope composition of the water samples extracted from cores from a single well are also correlated with TDS, either negatively or positively depending on the TDS of formation water compared to that of the drilling mud. This provides a second line of evidence for mixing between formation waters with lower $\delta^{18}O$ and $\delta^2H$ values and drilling fluids with elevated $\delta^2H$ and $\delta^{18}O$ values.

Given the primary observations that 1) water samples extracted from drill core are a mixture of formation fluids and drilling mud, and that 2) the stable isotope composition of McMurray Formation waters fall on or near the local meteoric water line 208, the intersection of the line formed by the measured isotope data with the local meteoric water line 208 is interpreted as a close approximation of the stable isotope composition of the reservoir formation waters. The intersection point of the local meteoric water line 208 and the formation water $\delta^{18}O$-$\delta^2H$ regression line was solved using Equations 2-4.

$$\delta^2H=7.66(\delta^{18}O)-1 \quad [2]$$

Edmonton Local Meteoric Water Line:

$$\delta^2H=m_s(\delta^{18}O)+b_s \quad [3]$$

$b_s$ and $m_s$ represent the $\delta^2H$-intercept and slope of the line generated by the isotope data for formation waters from each investigated well. Allowing Equations 2 and 3 to have equal $\delta^2H$ values, and re-arranging the equation, Equation 4 represents the intersection of the two lines:

$$\delta^{18}O=(b_s+1)/(7.66-m_s) \quad [4]$$

Equation 4 permits calculation of the reservoir formation water $\delta^{18}O$ value generated by the intersection of the regression line (isotope mixing line 204) with the local meteoric water line 208. The $\delta^2H$ value for reservoir formation water is calculated by substitution into Equations 2 or 3.

The calculation of TDS values for reservoir water is conducted in a similar fashion to the determination of water isotope compositions. A least squares regression line (TDS mixing line 210) is generated for the TDS-$\delta^{18}O$ system, and the equation solved using the $\delta^{18}O$ value calculated in Equation 4. In the first and second wells that were evaluated, formation waters with lower $\delta^{18}O$ values had higher TDS concentrations than those with higher $\delta^{18}O$ values, consistent with drilling mud having lower TDS values than reservoir formation water. However, in the third well, TDS values decreased with lower $\delta^{18}O$ values, suggesting that the drilling fluid had a greater TDS value than the reservoir formation water. These observations are consistent with drilling fluids for sampled wells having TDS values that fall within the measured range of mud samples. These observed formation water stable isotope compositions are also consistent with a drilling fluid stable isotope composition that plots to the right of the local meteoric water line 208.

The calculated formation water $\delta^{18}O$ value for each investigated well was indicated similar to the diamond plot points 202 shown in FIG. 14. The $R^2$ values generated by the mixing lines for each TDS-$\delta^{18}O$ system were found to be high, ranging from 0.84 to 0.99, demonstrating a high degree of correlation between the measured parameters.

The TDS values calculated for formation water were also plotted, similar to the circle plot points 212 shown in FIG. 14.

Therefore, the formation water properties obtained from the method described herein are consistent with regional understanding of heterogeneity in groundwater geochemistry in the McMurray Formation, and suggest that the data are representative of in situ conditions in the reservoir. The results confirm that the very large differences in observed McMurray Formation groundwater TDS values are also present in the reservoir itself, and thus should be considered a variable during resource evaluation.

It may be noted that the method should be performed using multiple water samples from several depths within a reservoir to effectively determine original reservoir water chemistry and stable isotope composition of formation water. For example, at least five water samples >5.0 mL representing different levels of drilling fluid contamination is recommended to generate adequate mixing lines. It may also be noted that reservoir waters investigated in this study were homogenous in TDS, as the $R^2$ values of the mixing lines for the respective parameters for samples from the three wells were very high, suggesting a two-end member mixing relationship. However, multiple different water sources can be observed in systems where shales are barriers to fluid flow.

The method described herein therefore provides a method for determining the formation water $\delta^{18}O$, $\delta^{2}H$, and TDS values directly from drill core samples 252 in a bitumen-saturated reservoir, by calculating a mixing relationship between selected parameters in formation waters and drilling fluids. The results obtained by this technique are generated independent of the drilling fluid compositions, and therefore do not require knowledge of drilling fluid chemistry to calculate TDS and isotope compositions of original formation water. The stable isotope ratios and total dissolved solids concentrations calculated using this method are consistent with regional TDS and stable isotope trends known from groundwater well sampling, suggesting that accurate values for original formation water can be determined on a well-by-well basis using this method. As such, information about reservoir water salinity and stable isotope composition can be obtained throughout a lease area using data from exploration wells, thus greatly increasing the frequency of TDS and stable isotope measurements within oil sands lease areas.

The method can also be used to improve calibration of geophysical tools for characterization of water and bitumen saturation, and resultant improvement in efficiency of steam-based bitumen recovery techniques.

The analyses described above and shown in FIGS. 14 to 17 can therefore be performed for various purposes, including for planning bitumen extraction sites that are not suitable for mining or existing in situ techniques but can be accessed using the in situ gravity drainage technique described in FIGS. 1 to 13.

Predicting High Risk Areas for Bitumen Recovery

In addition to estimating the stable isotope composition and other characteristics such as the TDS from formation water extracted from a core sample 252, the following describes a process for using such chemical data from the formation water samples 256 in one of multiple techniques that can be used to assist in predicting high risk areas associated with bitumen recovery. For example, the following process can be used as a technique to assist in predicting or analyzing potential large scale seepage into mines and/or high risk areas for caprock integrity, e.g. a surface release of steam from SAGD operations.

It has been recognized that faults or fractures that are very permeable (or open) and penetrate from surface or McMurray to the Devonian can be associated with high risk areas for caprock integrity or seepage into oil sands mines. In general, there is an impermeable barrier between the McMurray formation and the deeper Devonian. If permeable faults exist providing connectivity between the Devonian and McMurray, there can be an elevated risk for sudden large seepage events into oil sands mines. Similar faults can continue to surface where they can pose weaknesses in the caprock, creating areas of potential elevated risk for caprock integrity.

In certain areas of the Athabasca where there is enough pressure in the formation water of the Devonian, these permeable faults can have water flowing up through the faults from the Devonian into the McMurray. Where faults exist that are not very permeable, water is less likely to move up these faults.

The following process provides a technique to assist in, e.g., the prediction of a release of formation water and/or steam resulting from the disturbance of the earth, so that such disturbance can be avoided. Such disturbance can be caused by mining operations or by SAGD operations. The risk of such release is present in the Athabasca region, and, in particular, within areas with an active karst system. It is possible that karst processes have locally weakened the overburden, and/or provided conduits through which fluids can preferentially flow from an overpressurized Devonian aquifer. With further disturbance of the subterranean formation, vertical connectivity can become effected between the surface and the Devonian aquifer, thereby resulting in the surface discharge of water from the aquifer. If extension of a subsurface fracture, resulting in vertical connectivity between the surface and the aquifer, is effected by SAGD operations, this can also result in the surface discharge of steam.

Geochemical data can be used in two ways to detect permeable faults. First the water from the Devonian is typically much more saline than formation water in the McMurray that is sourced from surface recharge. Hence, areas of high salinity in the McMurray formation water indicate upward movement of groundwater along these faults. Second, the Devonian formation waters have high levels of sulfate. Sulfate in the McMurray formation will be quickly eliminated in geological time by biodegradation. Hence areas of elevated sulfate, particularly those with a calcium-to-sulfate ratio near 1 indicate very recent upwelling of water from the Devonian in geological time. It can be appreciated that the above-described method for determining TDS can be used to determine the salinity of the formation water, when analyzing contaminated water from a core sample. A similar process can be used to determine the level of sulfate. It can also be appreciated that the risking methodology described herein can be used on any water analysis, the above-described porewater method being but one example.

The process includes analyzing formation water (whether contaminated or uncontaminated) for salinity and sulphate ions, as well as for the ratio of calcium ions to sulphate ions. Formation waters from Devonian aquifers are primarily Na—Cl type, and also contain dissolved calcium and sulphate ions. Due to the presence of bacteria within oil sands reservoirs, and because such bacteria tends to consume the sulphate ions, the ratio of sulphate ions to calcium ions tends to be low within formation water present in oil sands reservoirs, unless there has been recent vertical flow from the Devonian aquifers to replenish the consumed sulphate ions. Accordingly, high salinity, high sulphate ion concentration, and high ratio of sulphate ion to calcium ion within the formation water are risk factors for water or steam discharge.

It has been found therefore, that areas of particular high risk will have elevated salinity and sulfate levels in the McMurray formation water and calcium to sulfate ratios near 1. Areas of moderate risk will have high salinity and low sulfate or high sulfate and low salinity. Areas of low risk would have low salinity and low sulfate levels.

Figure 19:
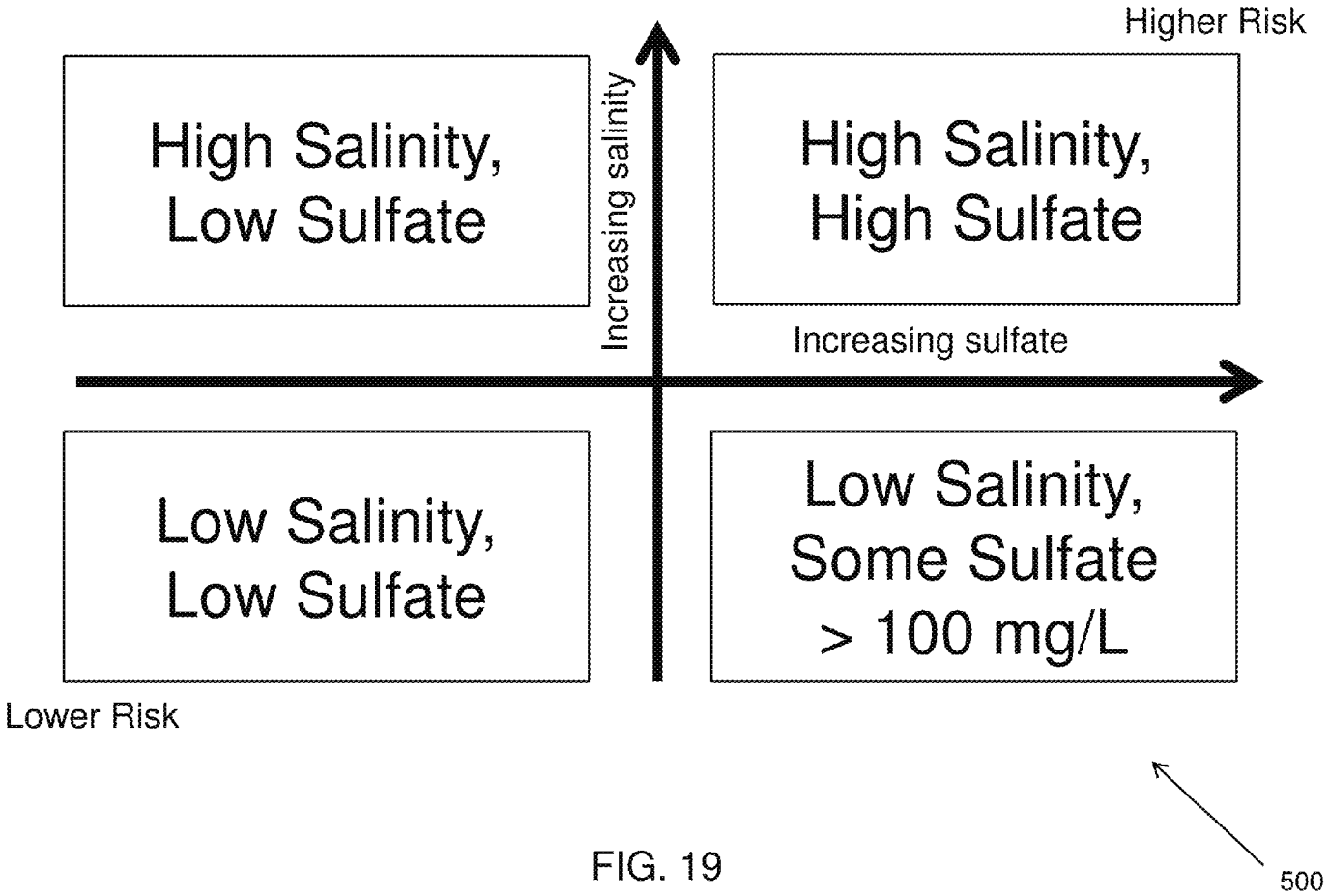
FIG. 19 is a schematic illustration of a risk matrix for surface discharge of aquifer water based on salinity and sulfate levels.

FIG. 19 illustrates a risk matrix 500 in which levels of risk are assigned based on different levels of detected salinity and sulfate in the formation water. In the risk matrix 500, formation waters with low salinity and low sulfate levels are designated as lower risk, while formation waters with high salinity and high sulfate levels are designated as higher risk. As either salinity or sulfate levels increase while the other level is similar, intermediate levels of risk can be identified, such as formation waters that indicate high salinity but low sulfate or which indicate low salinity but some sulfate, e.g., >100 mg/L. The risk matrix 500 shown in FIG. 19 is for illustrative purposes. In other examples, further granularity can be added by creating additional levels or gradients of risk, e.g., by creating a 5×5 matrix, a 6×6 matrix, etc.

Figure 20:
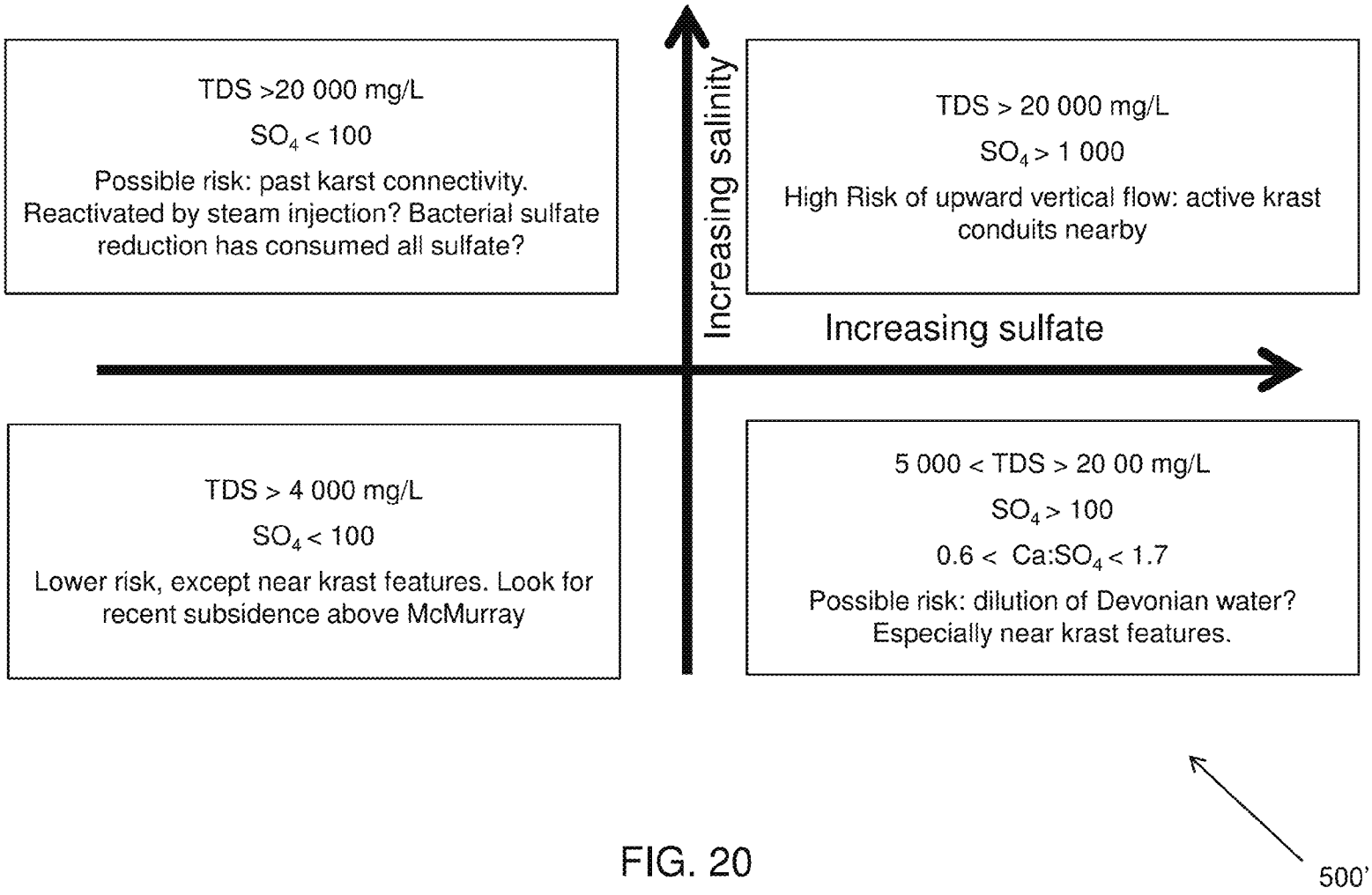
FIG. 20 is a schematic illustration of a risk matrix for surface discharge of aquifer water based on salinity and sulfate levels.

FIG. 20 illustrates additional parameters that can be used to determine into which cell in the risk matrix 500' a particular formation water sample falls. In the example shown in FIG. 20, lower risk samples are detected based on TDS being <4 000 mg/L and sulfate levels of $SO_4$<100. For example, with such readings, the area would be considered lower risk except near karst features suggesting that recent subsidence should be determined above the McMurray formation.

Higher risk samples in this example would be those having TDS >20 000 mg/L and sulfate levels of $SO_4$>1000. A higher risk area can indicate a high risk of upward vertical flow suggesting active karst conduits nearby (see also FIG. 18).

The intermediate risk areas can occur when detecting a TDS >20 000 mg/L but sulfate levels of $SO_4$<100 thus indicating a possible risk. For example, past karst connectivity could be present which could be reactivate by steam injection. Alternatively, the possible risk could stem from bacterial sulfate reduction which has consumed the sulfate, thus explaining the lower sulfate levels.

Intermediate risk areas can also occur when detecting a TDS in the range of 500 to 20 000 mg/L and a sulfate level of $SO_4$>100. Moreover, in the example shown in FIG. 20, the ratio of Ca:$SO_4$ of between 0.6 and 1.7 can also indicate a possible risk. The possible risk could stem from dilution of the Devonian water, e.g., near karst features. The ranges and values shown in FIG. 20 are illustrative and can be varied according to the field data acquired, etc.

FIG. 21 illustrates the application of the risk matrix 500 to a particular mine known to have had a large unexpected influx of formation water into a mine. The area of influx is marked by reference numeral 600. In this example, the area of influx 600 is on the edge of a depression created by karsting, which is a high risk zone for faulting that can create a permeable pathway from the Devonian to the McMurray. It may be noted that while the salinity levels are low, the sulfate ratios are close to 1 in the area where the influx occurred.

Accordingly, formation waters in potential mineable formations can be analyzed using any water analysis, including analyses conducted on uncontaminated formation waters, and analyses conducted on contaminated formation waters, e.g., using the process illustrated in FIGS. 14 to 17 (e.g., determination of TDS, and sulfates). These analyses can then be used to assess risk using the matrices of FIGS. 19 and 20, e.g., to determine the risk of surface discharge of aquifer water. The determination of such risk areas can be used in planning bitumen extraction sites to determine areas that are more suitable for the in situ gravity drainage method described herein than surface mining or other in situ techniques such as SAGD.

It will be appreciated that any module or component exemplified herein that executes instructions can include or otherwise have access to computer readable media such as storage media, computer storage media, or data storage devices (removable and/or non-removable) such as, for example, magnetic disks, optical disks, or tape. Computer storage media can include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media can be part of the computing device 260, chemical analysis apparatus 258, or any component of or related thereto, or accessible or connectable thereto. Any application or module herein described can be implemented using computer readable/executable instructions that can be stored or otherwise held by such computer readable media.

For simplicity and clarity of illustration, where considered appropriate, reference numerals can be repeated among the figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, well-known methods, procedures and components have not been described in detail so as not to obscure the examples described herein. Also, the description is not to be considered as limiting the scope of the examples described herein.

The examples and corresponding diagrams used herein are for illustrative purposes only. Different configurations and terminology can be used without departing from the principles expressed herein. For instance, components and modules can be added, deleted, modified, or arranged with differing connections without departing from these principles.

The steps or operations in the flow charts and diagrams described herein are for example. There can be many variations to these steps or operations without departing from the principles discussed above. For instance, the steps can be performed in a differing order, or steps can be added, deleted, or modified.

Although the above principles have been described with reference to certain specific examples, various modifications thereof will be apparent to those skilled in the art as outlined in the appended claims.

The invention claimed is:

1. A method of recovering bitumen from a bitumen reserve, the method comprising:

recovering bitumen from an alternative pay region in the bitumen reserve via gravity drainage using an inclined horizontally drilled well drilled from an open drainage pit upwardly into the bitumen reserve; wherein the open drainage pit has been excavated into an area of an underlying formation that is, at least in part, adjacent to and underlying the bitumen reserve; and wherein the alternative pay region comprises a region neither suitable for recovering bitumen by surface mining nor suitable for recovering bitumen by in situ recovery using wells that produce bitumen to ground level above the alternative pay region.

2. The method of claim 1, wherein the area of the underlying formation is exposed.

3. The method of claim 2, wherein the area of the underlying formation is naturally occurring.

4. The method of claim 2, wherein the area of the underlying formation is located within an existing surface mining site.

5. The method of claim 1, wherein the area of the underlying formation is not exposed, the method further comprising excavating material to expose the area of the underlying formation.

6. The method of claim 5, further comprising:

conducting surface mining operations to expose the area of the underlying formation prior to the open drainage pit being excavated.

7. The method of claim 5, further comprising:

determining that the underlying formation is unsuitable for surface mining and unsuitable for an in situ recovery process prior to excavating the material to expose the area of the underlying formation.

8. The method of claim 7, wherein the area is located near one or more of: at least one Karst feature in the underlying formation; a body of water; adjacent an existing surface mining operation; adjacent a tailing pond.

9. The method of claim 1, wherein the bitumen reserve includes more than one alternative pay region and where a first inclined horizontal well is drilled towards a first alternative pay region, and a second inclined horizontal well is drilled towards a second alternative pay region.

10. The method of claim 9, wherein the first and second alternative pay regions are accessed from a same open drainage pit.

11. The method of claim 9, wherein the first and second alternative pay regions are accessed from first and second open drainage pits excavated in the area of the underlying formation.

12. The method of claim 1, wherein the alternative pay region is located between a surface mining site and an in situ bitumen recovery site.

13. The method of claim 1, wherein recovering bitumen comprises operating a steam assisted in situ bitumen recovery process.

14. The method of claim 13, wherein the steam assisted in situ process comprises directing the well upwardly to enable gravity assisted recovery of bitumen in the alternative pay region.

15. The method of claim 13, wherein the steam assisted in situ process comprises a cyclic steam stimulation (CSS) system.

16. The method of claim 13, wherein the steam assisted in situ process comprises a steam assisted gravity drainage (SAGD) system, the SAGD system comprising an injector well configured to inject steam into the bitumen reserve and a producer well configured to produce a bitumen-containing fluid from the bitumen reserve.

17. The method of claim 16, wherein the injector well and the producer well are both drilled from within the open drainage pit.

18. The method of claim 16, wherein the injector well is drilled from surface and the producer well is drilled from the open drainage pit.

19. The method of claim 1, wherein recovering bitumen comprises operating a combustion process by injecting a combustible fuel into the bitumen reserve using an injector well and producing a bitumen-containing fluid from the bitumen reserve using a producer well.

20. The method of claim 1, wherein recovering bitumen comprises using of at least one technique selected from the group of: solvent injection, carbon dioxide flooding, non-condensable gas injection, flue gas flooding, surfactants injection, alkaline chemicals injection, and microbial enhanced recovery.

21. The method of claim 1, further comprising determining the alternative pay region within the bitumen reserve.

22. The method of claim 1, further comprising excavating the open drainage pit into the area of the underlying formation.

23. The method of claim 1, further comprising drilling the inclined horizontally drilled well from the open drainage pit and towards the alternative pay region.

24. A method of planning bitumen recovery from a geographical region, the method comprising:

determining a region comprising at least one area of an underlying formation, the underlying formation being adjacent to and at least partially underlying a bitumen-containing reservoir;

determining at least one alternative pay region, wherein an alternative pay region comprises a region neither suitable for recovery of bitumen by surface mining nor suitable for recovering bitumen by in situ recovery using wells drilled from ground level for producing bitumen to ground level above the alternative pay region; and identifying a location for excavating at least one open drainage pit into the at least one area of underlying formation, the at least one open drainage pit enabling at least one inclined horizontally drilled well to be drilled towards the at least one alternative pay region to recover bitumen from the at least one alternative pay region.

25. The method of claim 24, wherein the at least one area of the underlying formation is exposed.

26. The method of claim 25, wherein the at least one area of the underlying formation is located within an existing surface mining site.

27. The method of claim 24, wherein the at least one area of the underlying formation is naturally occurring in the geographical area.

28. The method of claim 24, wherein the at least one area of the underlying formation has not been exposed.

29. The method of claim 28, further comprising determining that the region is suitable for surface mining.

30. The method of claim 28, further comprising determining that the region is unsuitable for surface mining and unsuitable for an in situ recovery process.

31. The method of claim 24, further comprising determining that a first inclined horizontally drilled well is to be drilled towards a first alternative pay region, and that a second inclined horizontally drilled well is to be drilled towards a second alternative pay region.

32. A system for recovering bitumen from a geographical area, the system comprising:

an open drainage pit excavated into an area of an underlying formation, the underlying formation being adjacent to at least partially underlying a bitumen-containing reservoir;

at least one inclined horizontally drilled well drilled from the open drainage pit and towards an alternative pay region included in the bitumen-containing reservoir, wherein the alternative pay region comprises a region neither suitable for recovering bitumen by surface mining nor suitable for recovering bitumen by in situ recovery using wells that produce bitumen to ground level above the alternative pay region; and production equipment for operating the well to recover bitumen from the alternative pay region.

* * * * *